US008109344B1

(12) United States Patent
Hays

(10) Patent No.: US 8,109,344 B1
(45) Date of Patent: Feb. 7, 2012

(54) AUXILIARY ROTARY TOOL DRIVE FOR HAND-HELD POWER TOOLS

(76) Inventor: John N. Hays, Houston, TX (US)

( * ) Notice: Subject to any disclaimer, the term of this patent is extended or adjusted under 35 U.S.C. 154(b) by 239 days.

(21) Appl. No.: 12/426,174

(22) Filed: Apr. 17, 2009

Related U.S. Application Data

(60) Provisional application No. 61/124,317, filed on Apr. 17, 2008.

(51) Int. Cl.
*B25F 3/00* (2006.01)

(52) U.S. Cl. ..... 173/50; 173/214; 173/171

(58) Field of Classification Search ..... 173/50, 173/214, 171
See application file for complete search history.

(56) References Cited

U.S. PATENT DOCUMENTS

| | | | | |
|---|---|---|---|---|
| 1,650,911 | A | 11/1927 | Schneider | |
| 1,750,957 | A | 3/1930 | Fowler | |
| 2,679,770 | A | 6/1954 | Carter et al. | |
| 4,299,004 | A | 11/1981 | Lancaster | |
| 4,604,005 | A | 8/1986 | Russ | |
| 4,810,916 | A | 3/1989 | McBride | |
| 5,065,498 | A | 11/1991 | McKenzie | |
| 5,149,230 | A * | 9/1992 | Nett | 408/42 |
| 5,261,135 | A * | 11/1993 | Mitchell | 7/158 |
| 5,346,453 | A | 9/1994 | Rivera-Bottzeck | |
| 5,427,002 | A * | 6/1995 | Edman | 81/57 |
| 5,564,717 | A * | 10/1996 | Alberts | 279/145 |
| 6,007,277 | A | 12/1999 | Olson et al. | |
| 6,039,020 | A * | 3/2000 | Kawamoto et al. | 123/196 R |
| 7,367,757 | B2 * | 5/2008 | Phillips | 408/35 |
| 7,371,033 | B2 * | 5/2008 | Whitehead | 408/35 |
| 2003/0154946 | A1 * | 8/2003 | Momosaki et al. | 123/192.1 |

* cited by examiner

*Primary Examiner* — Brian D Nash
(74) *Attorney, Agent, or Firm* — Kenneth A. Roddy

(57) ABSTRACT

An auxiliary rotary tool drive apparatus mounted on, or an integral component of, hand-held rotary power tool has an extendable and retractable auxiliary drive shaft and a gear assembly that is selectively operatively engaged with the power transmitting shaft and gear assembly of the power tool and driven thereby using only the hand grasping the power tool for driving screws, fasteners, bits or other work performing members attached to the auxiliary drive shaft without having to move or remove the existing work performing member from the holding member of the power tool.

23 Claims, 13 Drawing Sheets

AUXILIARY ROTARY TOOL DRIVE FOR HAND-HELD POWER TOOLS

CROSS REFERENCE TO RELATED APPLICATION

This application claims priority of U.S. Provisional Application Ser. No. 61/124,317, filed Apr. 17, 2008.

BACKGROUND OF THE INVENTION

1. Field of the Invention

This invention relates generally to hand-held power tools, and more particularly, to an auxiliary rotary tool drive apparatus that is mounted on, or an integral component of, a hand-held rotary power tool, such a rotary drill, and has an extendable and retractable auxiliary drive shaft and a gear assembly that is selectively operatively engaged with the drive shaft and gear assembly of the power tool and driven thereby using only the hand grasping the drill for driving screws, fasteners, bits or other work performing members attached to the auxiliary drive shaft without having to move or remove the existing drill bit or work performing member from the chuck of the power drill.

2. Background Art

As used herein, the term "rotary power tool" means a tool having a housing containing a driving motor and a drive train connected with a power transmitting shaft (drive shaft, spindle or anvil) that extends forwardly from the housing and may have a chuck or holding member at its outer end which grips a work performing member to be rotatably driven. Power tools are classified as either stationary or portable, where portable means "hand-held". Common power tools include drills, drivers, drill/drivers, screwdrivers, and hammer drills or impact drills. In hammer drills or impact drills, the drive shaft is referred to as an "anvil". As used herein, the terms "chuck" or "holding member" means any device that holds bits, rotating tools, fasteners or other work performing members to the power transmitting shaft of the power tool. As used herein, the term "work performing member" can include such devices as drill bits, screws, fasteners, screw drivers, nuts, bolts, finishing tools, and other rotary devices which can be releasably engaged in the chuck or holding member connected to the rotary power transmitting shaft (drive shaft, spindle or anvil). As used herein, the terms "drive shaft" and "auxiliary drive shaft" means the power transmitting shaft, spindle, or anvil of the power tool and the auxiliary rotary tool drive apparatus, respectively.

The task of a driving a screw or fastener into a surface typically involves first drilling a pilot or starter hole, then driving the screw or other fastener into the previously drilled pilot hole. These two tasks, drilling and driving, require either using two different bits in the same drill, or using two drills with one utilizing a drill bit and the other utilizing a screw driving bit.

If a single conventional power drill is used, at least one bit change is needed to complete both tasks. This requires loosening and removing the drill bit from the chuck and inserting the appropriate screw driver bit and tightening the drill chuck. Use of a double ended bit held in a quick change adapter clamped in the drill chuck, is somewhat easier and quicker, however, it still requires releasing, removing, turning, and reinserting the dual ended bit.

Both of these scenarios are time consuming and changing bits greatly increases the probability of dropping and losing a bit or other rotary tool. It also requires the use of two hands. Since these procedures require both hands to change the bit, the user is precluded from grasping a secure structure while completing the bit changing process, which can be potentially dangerous if done on a ladder, scaffold, or any high or unstable platform.

Using two drills, the first equipped with a drill bit and the second equipped with a screw driving bit, requires repeatedly laying down the first drill and picking up the second. This process of changing back and forth between the required drills is time consuming and quickly becomes tedious, particular when it is done frequently or repetitively.

Others have attempted to correct the above-mentioned problems. However, none appear to have successfully solved all the problems, nor appear to be capable of drilling a pilot hole and driving a screw immediately in the hole using only one hand and without turning or regrasping the drill or tool.

There are several patents directed toward various rotary tools with more than one output; however, they all share similar drawbacks when faced with the task of drilling a hole and subsequently driving a screw in the hole. They require the use of two hands and regrasping the tool to drill a hole and subsequently drive a screw in the hole.

U.S. Pat. No. 1,650,911 to Schneider discloses a rotary power tool having a dual drive output that is adaptable for use as a drill, a screw driver, a tapper and a wrench. The disadvantage of this tool is that the toolheads extend therefrom in the same direction and operate at roughly the same working length. For example, in order to use the screw driver, the chuck containing the drill bit must be loosened and the drill bit must be removed to prevent it from contacting the surface into which the screw is to be driven.

U.S. Pat. No. 1,750,957 to Fowler discloses a drill attachment having extensions therefrom in opposite directions. The drill of one extension rotates clockwise and the chuck or attachment of the other extension rotates counter-clockwise as viewed from the main body of the tool. The tool is not able to drill a hole and subsequently drive a screw in the hole without first reversing shaft rotation and releasing, turning and regrasping the tool, which is a cumbersome and time-consuming process.

U.S. Pat. No. 4,299,004 to Lancaster discloses a powered hand tool for household cleaning operations having two drive shafts for polishing wheels extending therefrom in perpendicular directions. The polishing wheels turn in opposite directions as viewed from each of their drives, and the drives are not extendable. In addition, the perpendicular drives could result in interference when working in a corner. These factors would make applying this invention to drilling and rotary fastening very impractical and inconvenient.

U.S. Pat. No. 4,810,916 to McBride teaches a rotary power tool that includes two extensions in opposite directions therefrom. The power tool may utilize a screwdriver bit at one extension and a drill at the other extension. Although both the screwdriver bit and the drill bit are rotatable in the same working direction as seen looking toward each driven portion, it still requires two hands and regrasping to accomplish drilling a hole and subsequently driving a screw in the hole. This results in a cumbersome and time-consuming process.

There are also several patents directed toward various power hand tools that provide a magazine carrying several different bits or rotary tools and a way of selecting the one needed by aligning the bit or tool with a chuck axis, moving the bit or tool into place, and tightening the chuck. If the chuck already contains a bit or tool, you must first loosen the chuck to remove the bit or tool and return it to the magazine before utilizing a different bit or tool. There are also several patents directed toward hand-held power drills having a mechanism that operates similar to a rifle "bolt-action" to selectively engage a driver bit with the primary drive shaft that also drives the chuck that carries a drill bit, and patents having a rotatable magazine, similar to a revolver, that carries a plurality of drill bits from which a single bit is selected and engaged in the chuck driven by the primary drive shaft, and patents directed toward the turret type power tools having a turret that carries dual or multiple chucks that can be selectively engaged with the primary drive shaft.

U.S. Pat. No. 5,065,498 to McKenzie discloses a drill having a magazine containing a multiplicity of bits from which a single bit is selected using a bolt action, but only one drive shaft. The drawback to this method is that it is cumbersome to use and requires two hands to operate and change the selected rotary tool.

U.S. Pat. No. 4,604,005 to Russ discloses a portable selector drill having a rotatable magazine, similar to a revolver, which carries a plurality of drill bits from which a single bit is selected and is driven forward into the chuck driven by the primary drive shaft.

U.S. Pat. No. 2,679,770 to Carter et al discloses a portable tool selective drill having a rotatable housing that is mounted at the front end of the drill and replaces the existing chuck. The housing carries a plurality of drill bits and is manually rotated to engage and drive the selected bit with the primary drive shaft.

U.S. Pat. No. 6,007,277 to Olson et al discloses a portable selector drill having a rotatable magazine, similar to a revolver, but only a 120° segment, that carries a plurality of drill bits from which a single selected bit is driven forward by a cable mechanism into the chuck and driven by the primary drive shaft.

U.S. Pat. No. 5,346,453 to Rivera-Bottzeck discloses a portable electric drill having a rotatable cylindrical magazine within the drill housing for storing a plurality of bits, the magazine is rotated to bring a selected magazine bore in alignment with the central bore of a chuck assembly at the front of the drill. A flexible cable is slidable by hand between forward and rearward positions to eject a tool bit element from the magazine to the chuck and to return a tool bit from the chuck to the magazine.

As previously mentioned, the drawback to these inventions is that they are all cumbersome to operate and require two hands to operate and change the selected rotary tool.

Therefore, a need exists for a way to drill a hole and subsequently drive a screw, fastener, or other work performing member, without changing bits or other work performing members, swapping drills, and without releasing, turning, or regrasping the tool handle grip.

SUMMARY OF THE INVENTION

The present invention overcomes the aforementioned problems and is distinguished over the prior art by an auxiliary rotary tool drive apparatus mounted on, or an integral component of, and driven by, a conventional hand-held rotary power tool, such a rotary drill, which has an extendable and retractable auxiliary drive shaft and gear assembly operable using only the hand grasping the drill for driving screws, fasteners, bits or other work performing member attached to the auxiliary drive shaft, without having to move or remove the existing drill bit or work performing member from the chuck of the power tool. The auxiliary drive shaft is driven by a primary drive gear installed on the drive shaft and connected with the gear assembly drive train of the drill and operated using only the hand grasping the power tool by pressing a lever in combination with the trigger and forward/reverse control on the power tool.

One of the features and advantages of the present auxiliary rotary tool drive apparatus is that it provides users forced to wear heavy gloves or users having the use of only one hand, with the utility/ability to complete the tasks of predrilling a pilot hole and driving a screw or other fastener into the hole using a single hand without pause or re-grasping between the two tasks.

Another feature and advantage of the present auxiliary rotary tool drive apparatus is that it provides users that have artificially restricted dexterity, such as astronauts, deep sea divers, arctic technicians, or anyone that must drill holes and drive fasteners in an environment of restricted dexterity or movement, with the utility/ability complete the tasks of predrilling a hole and driving a screw, fastener into the hole using a single hand without pause or re-grasping between the two tasks.

Another feature and advantage of the present auxiliary rotary tool drive apparatus is that it can be safely and easily operated with a single hand, leaving the unused hand to brace or grasp a stable object for support and safety.

Another feature and advantage of the present auxiliary rotary tool drive apparatus is that it may be provided as an accessory which is adapted to be used with standard commercially available power tools such as drills and accommodates standard rotary tools, bits, screws, fasteners, or other work performing members.

Another feature and advantage of the present auxiliary rotary tool drive apparatus is that it allows fast and efficient changes of rotary tools, bits, screws, fasteners, or other work performing members.

Another feature and advantage of the present auxiliary rotary tool drive apparatus is that it may be mounted on, or an integral component of, a standard hand-held power tool, such as a drill, and has an auxiliary drive shaft that can retract so as not to not interfere with the normal operations of the power tool or a drill bit or other work performing member clamped in the chuck of the power tool.

Another feature and advantage of the present auxiliary rotary tool drive apparatus is that it has an auxiliary drive shaft that can extend past a drill bit or other work performing member clamped in the chuck of a standard hand-held power tool, such as a drill, so as not to not interfere with the normal operations of the power tool or a drill bit or work performing member installed in the chuck of the power tool, allowing the auxiliary rotary tool drive apparatus to operate unimpeded by the power tool with attached bit or work performing member.

Another feature and advantage of the present auxiliary rotary tool drive apparatus is that it has an extendable and retractable auxiliary drive shaft that does not extend beyond the profile of the conventional hand-held power tool to which it is mounted, thereby providing compactness and utility of the power tool on which it is mounted.

A further feature and advantage of the present auxiliary rotary tool drive apparatus is that it provides a user of a standard hand-held power tool, such as a drill, with the utility to quickly change back and forth between the use of the different bit, screws, fasteners, or other work performing members, without requiring the removal or replacement of the tools, bits, screws, fasteners, or work performing members.

A still further feature and advantage of the present auxiliary rotary tool drive apparatus is that it is simple in construction, inexpensive to manufacture, and is rugged and reliable in use.

Other features, advantages and objects of the invention will become apparent from time to time throughout the specification and claims as hereinafter related.

DESCRIPTION OF THE PREFERRED EMBODIMENTS

Figure 1:
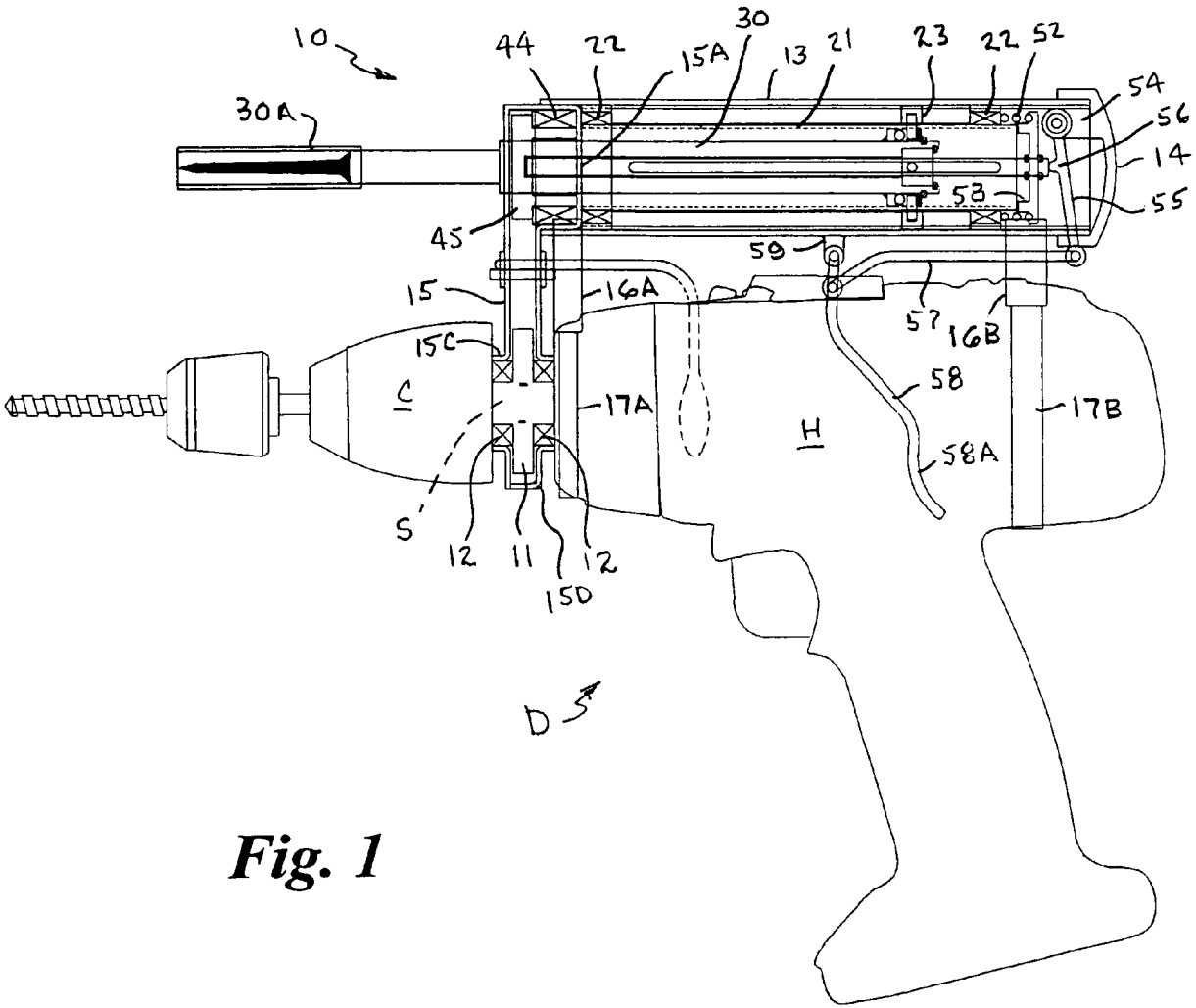
FIG. 1 is a side elevation of a mechanically operated auxiliary rotary tool drive apparatus in accordance with a first embodiment of the present invention, shown attached to a hand-held power drill and with the auxiliary drive shaft in the retracted position.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The hand-held rotary power tool depicted in the drawing figures is shown and described, for purposes of example only, as a conventional hand-held power drill, and it should be understood that the rotary power tool may be of any conventional type that has a housing containing a drive train connected with a power transmitting shaft (drive shaft, spindle or anvil) that extends forwardly from the housing and has a chuck or holding member mounted at the outer end thereof. For ease of understanding and simplifying the detailed description, the terms "drive shaft" and "auxiliary drive shaft" are used in the following discussion to refer to the power transmitting shaft, spindle, or anvil of the power tool and the auxiliary rotary tool drive apparatus, respectively. It should also be understood that the gear drive train and other components within the power tool housing are conventional and well known in the art, and therefore not shown or described in detail.

The present auxiliary rotary tool drive apparatus may be provided in a mechanically operated embodiment, or in a pneumatically operated embodiment. The mechanically operated embodiment and its operation will be described first with reference to FIGS. 1 through 9, followed by a description of the pneumatically operated embodiment and its operation with reference to FIGS. 10 through 17.

Mechanically Operated Embodiment

Referring to the drawings, in which like numerals designate like elements throughout the figures, FIG. 1 shows the mechanically operated embodiment of the auxiliary rotary tool drive apparatus 10 in cross section. As stated above, the present auxiliary rotary tool drive apparatus 10 is mounted on, or an integral component of, and driven by, a rotary power tool which, for purposes of example only, is depicted as a conventional hand-held power drill D having a housing H containing the usual gear drive train connected with a drive shaft S that extends forwardly from the housing and has a chuck C mounted at the outer end thereof. The gear drive train and other components within the drill housing are conventional and well known in the art, and therefore not shown or described in detail.

The auxiliary rotary tool drive apparatus 10 includes a primary drive gear 11 and a pair of primary gear bearings 12 at the front and rear of the primary drive gear which are installed on the drive shaft S of the drill D. In the illustrated example, the primary drive gear 11 and primary gear bearings 12 are shown installed on the drive shaft S of the drill D between the chuck C and the nose portion of the drill, however, it should be understood that these components may be installed on a power transmitting shaft (drive shaft, spindle or anvil) and at different locations and on rotary shafts which may or may not have a chuck at the forward end, depending upon the type of power tool with which the auxiliary rotary tool drive apparatus 10 is associated.

Figure 3:
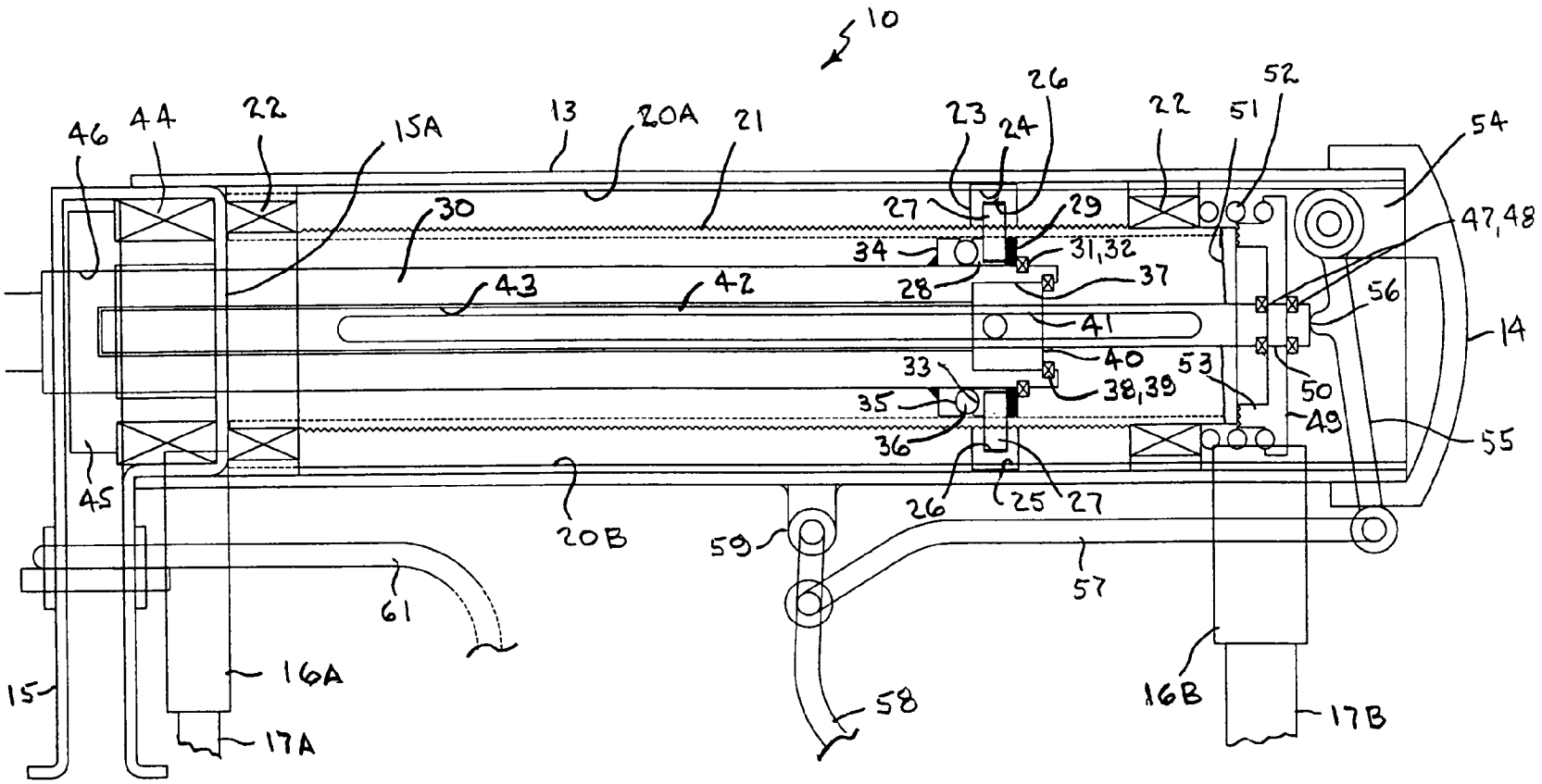
FIG. 3 is a longitudinal cross section through the mechanically operated apparatus shown in larger scale with the auxiliary drive shaft retracted.
Figure 4:
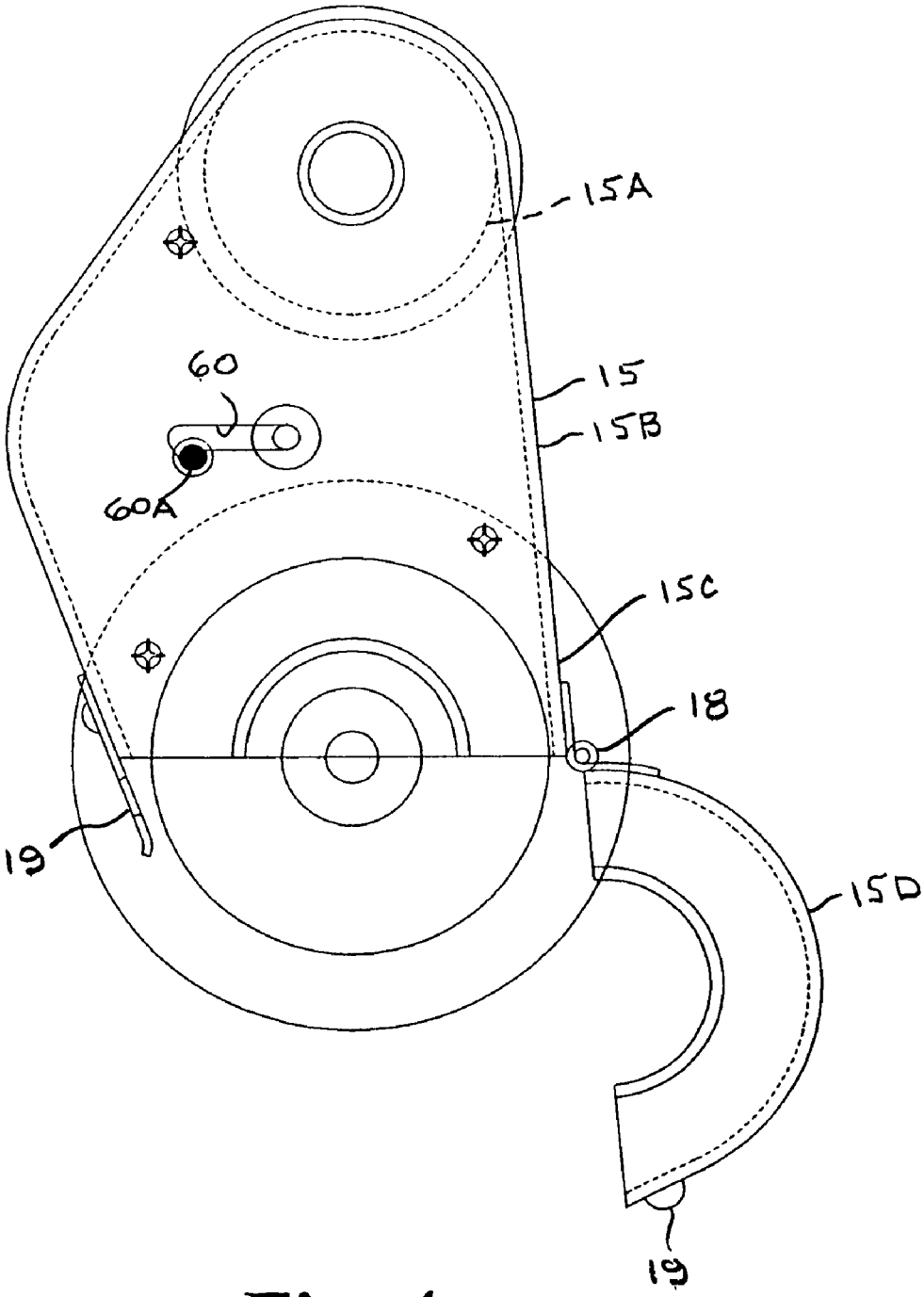
FIG. 4 is a cross sectional view of the drive gear case of the mechanically operated apparatus with the lower segment in an unlatched position and the gears removed to more clearly show the horizontal slot having an arcuate recess at its outer end.

The apparatus 10 has an elongate generally cylindrical housing 13 enclosed at its rear end by a cap 14 and has a drive gear case 15 attached at its front end (leftmost end as seen in the drawings). The elongate generally cylindrical housing 13 is attached to the top of the housing H of the power drill D by a front saddle 16A and a rear saddle 16B which are connected to the lower portion of the housing or case and securely fastened around the case or housing H of the power drill D by a front saddle strap 17A and rear saddle strap 17B, each having adjustable buckles. Other means for mounting the apparatus 10 to the case of housing H of the power tool or drill may be employed, including by way of example, hook and loop fasteners or other conventional fasteners. As best seen in FIGS. 3 and 4, the drive gear case 15 has a rearwardly protruding upper portion 15A that is engaged in the front end of the elongate cylindrical housing 13, an intermediate portion 15B extending downwardly therefrom, and a segmented cylindrical lower portion with an upper segment 15C and a lower segment 15D connected on one side by a hinge 18 and a releasable latch mechanism 19 on the opposed sides. When the lower portion segments are latched, the lower portion 15D engages the primary gear bearings 12 and enclose the primary drive gear 11 and bearings that are installed on the drive shaft S (spindle or anvil) between the chuck C and the nose portion of the drill D. A horizontal slot 60 is disposed in or on the drive gear case 15 and has a depending arcuate recess 60A at an outer end configured to releasably engage the central shaft of an engagement gear contained in the intermediate portion 15B of the drive gear case, as described hereinafter.

Figure 5:
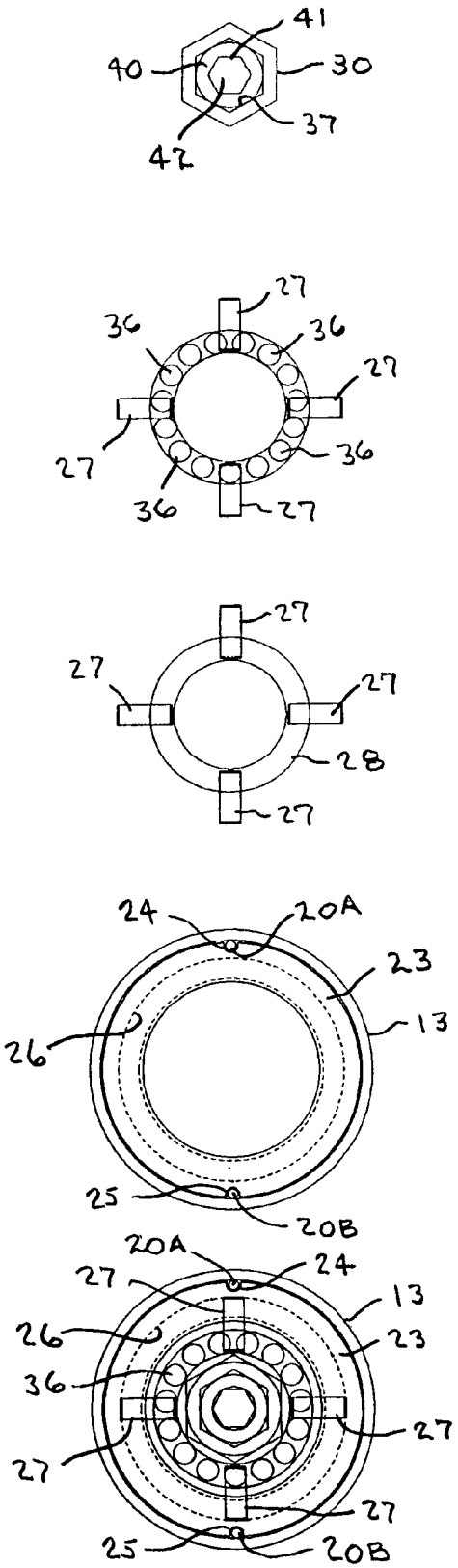
FIG. 5 is an exploded elevation view of the components of the screw ring of the mechanically operated apparatus.
Figure 6:
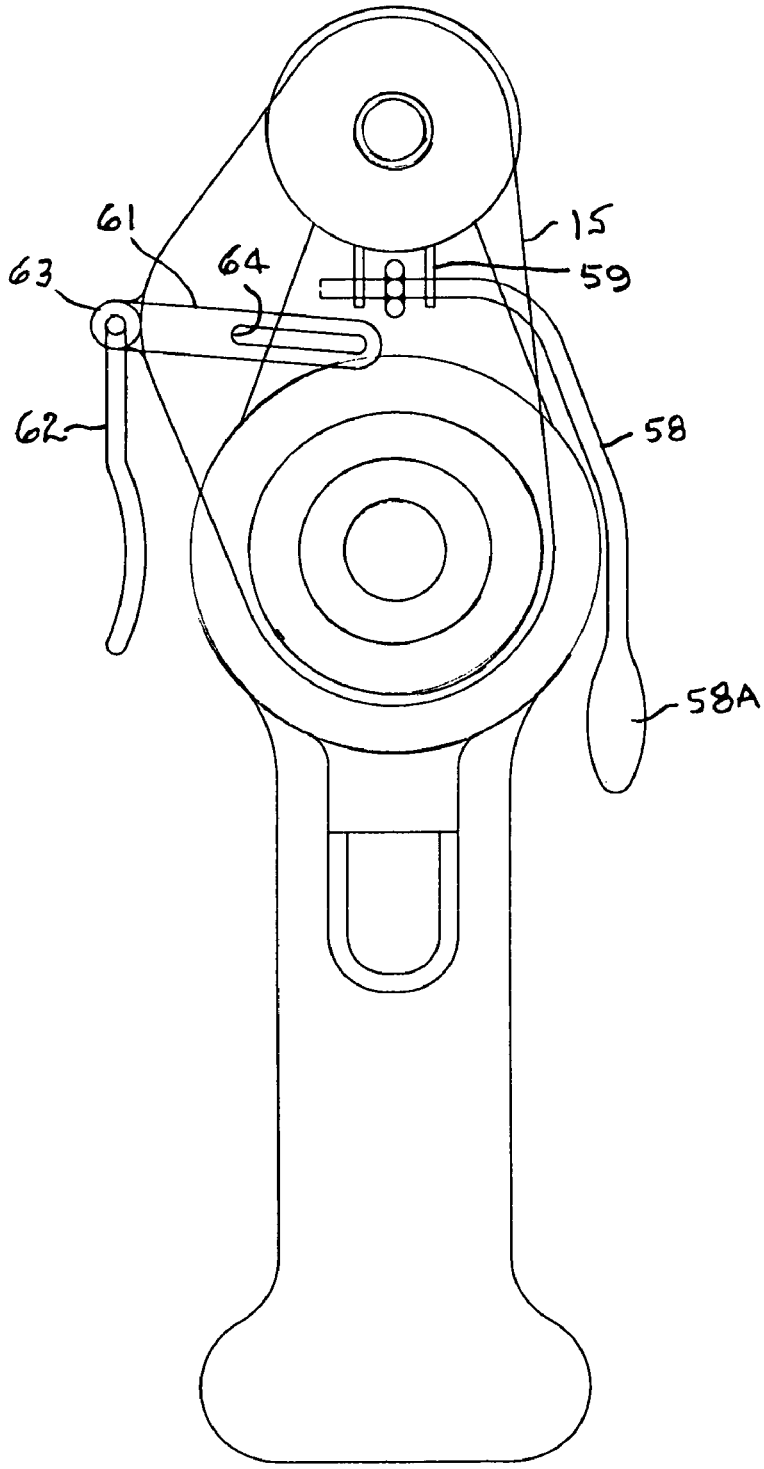
FIGS. 6 and 7 are cross sectional views of the drive gear case of the mechanically operated apparatus showing somewhat schematically the gear engagement lever and link, and the horizontal slot having an arcuate recess at its outer end with the gears removed to avoid confusion.
Figure 7:
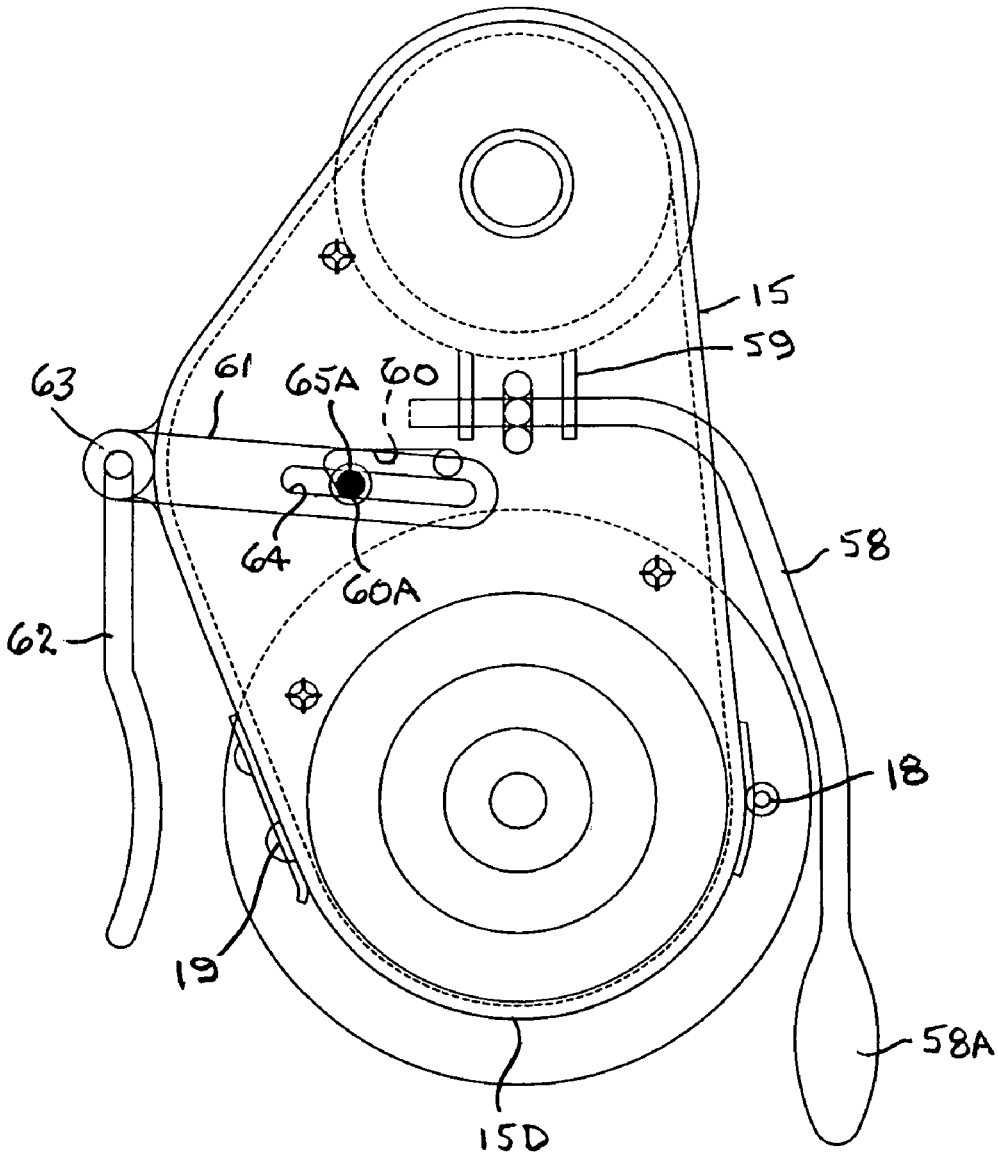

As best seen in FIGS. 3 and 5, a top rib 20A and a bottom rib 20B extend longitudinally along the interior of the elongate housing 13 at the top and bottom of the housing, respectively, in vertically opposed relation. An externally threaded extension tube 21 is supported within the housing 13 by bearings 22 at its front end and rear end, respectively. An internally threaded screw ring 23 is threadedly engaged on the external threads of the extension tube 21, and has a top channel 24 and a bottom channel 25 disposed in vertically opposed relation that are received on and slidably ride on the top and bottom ribs 20A and 20B, respectively. The ribs 20A, 20B prevent the screw ring 23 from rotating, such that when the extension tube 21 is rotated, the screw ring 23 will travel along the threaded length of the extension tube.

The interior diameter of the screw ring 23 is provided with an annular U-shaped inner groove 26 having an opening facing the center of the ring and receives the outer facing ends of four carrier plate pins 27 that freely rotate within the screw ring inner groove.

The outer facing ends of the four carrier plate pins 27 are contained in the outer L-shaped portion of a carrier plate 28 having a retaining washer 29 at its rear end segment. The retaining washer 29 is held in place and located on an elongate hexagonal auxiliary drive shaft 30 by a snap ring 31 installed in a snap ring groove 32 on the exterior of the auxiliary drive shaft. The front end wall of the L-shaped portion of the carrier plate 28 is provided with an arcuate recess 33. A front ball bearing retaining ring 34 having a rear wall with an arcuate recess 35 is welded to the exterior of the auxiliary drive shaft 30 forward of the carrier plate arcuate recess 33, and a plurality of ball bearings 36 are rotatably contained between the arcuate recesses and surround the hexagonal exterior of the auxiliary drive shaft 30.

The auxiliary drive shaft 30 has a hexagonal recess 37 and a snap ring groove 38 at its rear end, and a double hex drive transfer nut 40 having a hexagonal exterior is retained in the recess by a snap ring 39 received in the snap ring groove 38. The double hex drive transfer nut 40 has a central hexagonal bore 41, through which a hexagonal drive rod 42 slidably extends and travels in a hexagonal central bore 43 within the auxiliary drive shaft 30.

A cylindrical screw holder 30A is shown at the front end of the auxiliary drive shaft 30, which is shown for purposes of example, adapted to hold a screw but which may be adapted to hold another fastener type or even an auxiliary working member.

A secondary drive gear bearing 44 is mounted in the upper end of the drive gear case 15, which is disposed in the front end of the elongate housing 13. A secondary drive gear 45 is contained in upper end of the drive gear case 15 and has a tubular neck portion rotatably supported in the secondary drive bearing 44. A hexagonal bore 46 extends through the center of the secondary drive gear 45 and the front portion of the hexagonal auxiliary drive shaft 30 extends through the hexagonal bore.

The rear end of the hexagonal drive rod 42 extends beyond the rear end of the auxiliary drive shaft 30 and is provided with a pair of longitudinally spaced snap ring grooves 47. A drive plate 49 having a hexagonal bore 50 is mounted on the rear end of the hexagonal drive rod 42 by a pair of snap rings 48 received in the snap ring grooves 47 at the front and back side of the drive plate. A tube plate 51 having a central opening is secured to the back end of the extension tube 21. A compression spring 52 surrounds the rear end of the extension tube 21 and has one end engaged on the rearmost bearing 22 and its opposed end engaged on the drive plate 49. The front side of the drive plate 49 has a tubular extension 53 that contacts the back end of the tube plate 51 when a thumb lever (described hereinafter) is depressed.

The interior of the end cap 14, which encloses the rear end of the elongate housing 13, has a forwardly extending yoke 54 at its top end that that extends a distance into the interior of the housing 13, and the top end of drive plate lever 55 is pivotally mounted on the yoke. The drive plate lever 55 has a protrusion 56 that engages the back end of the hexagonal drive rod 42. The bottom end of the drive plate lever 55 is pivotally connected to the rear end of an actuation rod 57. The front end of the actuation rod 57 is pivotally connected to a thumb lever 58, which is pivotally connected at its top end to a yoke 59 on the underside of the elongate housing 13. The thumb lever 58 extends laterally outward from one side of the yoke 59 and curves downwardly closely adjacent to the drill housing H and terminates in a thumb rest portion 58A at its bottom end near the upper portion of the drill handgrip. When the thumb lever 58 is depressed, it pivots forward and carries the actuation rod 57 forward, which pivots the drive plate lever 55 to engage its protrusion on the back end of the hexagonal drive rod 42 and drive it forward, which drives the drive plate 49 forward against the pressure of the compression spring 52 to engage its tubular extension 56 on the tube plate 51 at the back end of the extension tube 21.

As best seen in FIGS. 4 and 6-9, a horizontal slot 60 is disposed in or on the drive gear case 15 and has a depending arcuate recess 60A at an outer end. A link 61 extends through the side of the drive gear case 15, and its outer end is connected to the horizontal leg of a generally L-shaped gear engagement lever 62 which extends rearwardly through a pivot connection 63 and downwardly along the side of the drill housing H and terminates near the trigger of the power drill. The inner facing end of the link 61 is provided with a slot 64 which is superposed in spaced relation over the horizontal slot 60.

An engagement gear 65 is disposed in the interior of the drive gear case 15 and has a central shaft 65A, one end of which is slidably and rotatably mounted in the horizontal slot 60 and the other end of which is slidably and rotatably mounted in the slot 64 of the link 61. A torsion spring 66 is fixed at one end to one side of the interior of the drive gear case 15, and its movable fee end is engaged with the engagement gear shaft 65A to move the engagement gear 65.

In a disengaged position (FIG. 8), the inner facing end of the link 61 and its slot 64 extend downwardly at an angle with respect to a horizontal axis, and the central shaft 65A of the engagement gear 65 is retained in the arcuate recess 60A at the outer end of the horizontal slot 60 by the angularly disposed slot 64 of the link 61, thereby retaining the engagement gear 65 in a laterally outward disengaged position against the force of the torsion spring 66.

To engage the engagement gear 65 (FIG. 9), the gear engagement lever 62 is pivoted, and the link 61 pivots upwardly to a horizontal position and, as its slot 64 moves upwardly, it moves the central shaft 65A of the engagement gear 65 out of the arcuate recess 60A of the horizontal slot 60, and when the slots are aligned, the force of the torsion spring 66 moves the engagement gear 65 inwardly to engage its teeth with the teeth of the primary drive gear 11 and the secondary drive gear 45.

Operation of the Mechanically Operated Embodiment

Referring now to FIGS. 1, 2, 3 and 4, the primary drive gear 11 is first installed on the drive shaft S (spindle or anvil) of the drill D between the chuck C and the nose portion of the standard power drill. Next, the apparatus 10 is installed on top of the drill housing H by mounting the front and rear saddles 16A and 16B on the top of the power drill, and securing the front and rear saddle straps 17A and 17B around the drill housing. The lower segment 15D of the drive gear case 15 is then closed around the primary drive gear 11 and latched by the latch 19.

Figure 9:
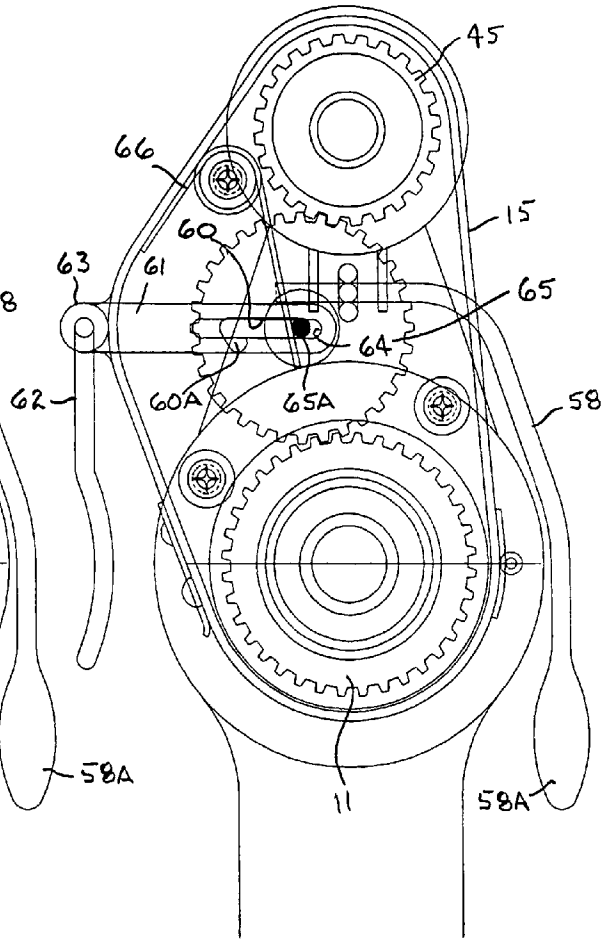
FIGS. 8 and 9 are cross sectional views of the drive gear case of the mechanically operated apparatus showing somewhat schematically the transfer gear assembly in a disengaged position and an engaged position, respectively.
Figure 8:
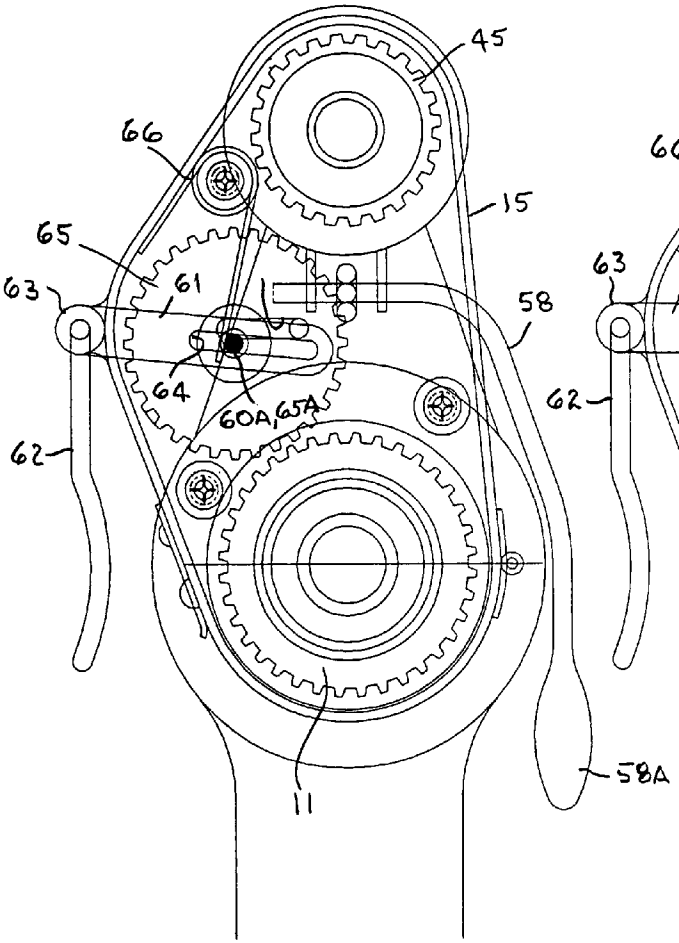

As seen in FIGS. 8 and 9, and described above, when the gear engagement lever 62 is pivoted, the engagement gear 65 is lifted and spring biased inwardly into tooth-to-tooth engagement with the primary drive gear 11 and secondary drive gear 45, which transfers the rotation of the primary drive shaft S of the drill to the secondary drive gear 45. The secondary drive gear 45 only rotates when the engagement gear 65 is engaged and the primary drive shaft S of the drill is rotating in either forward or reverse directions.

Figure 2:
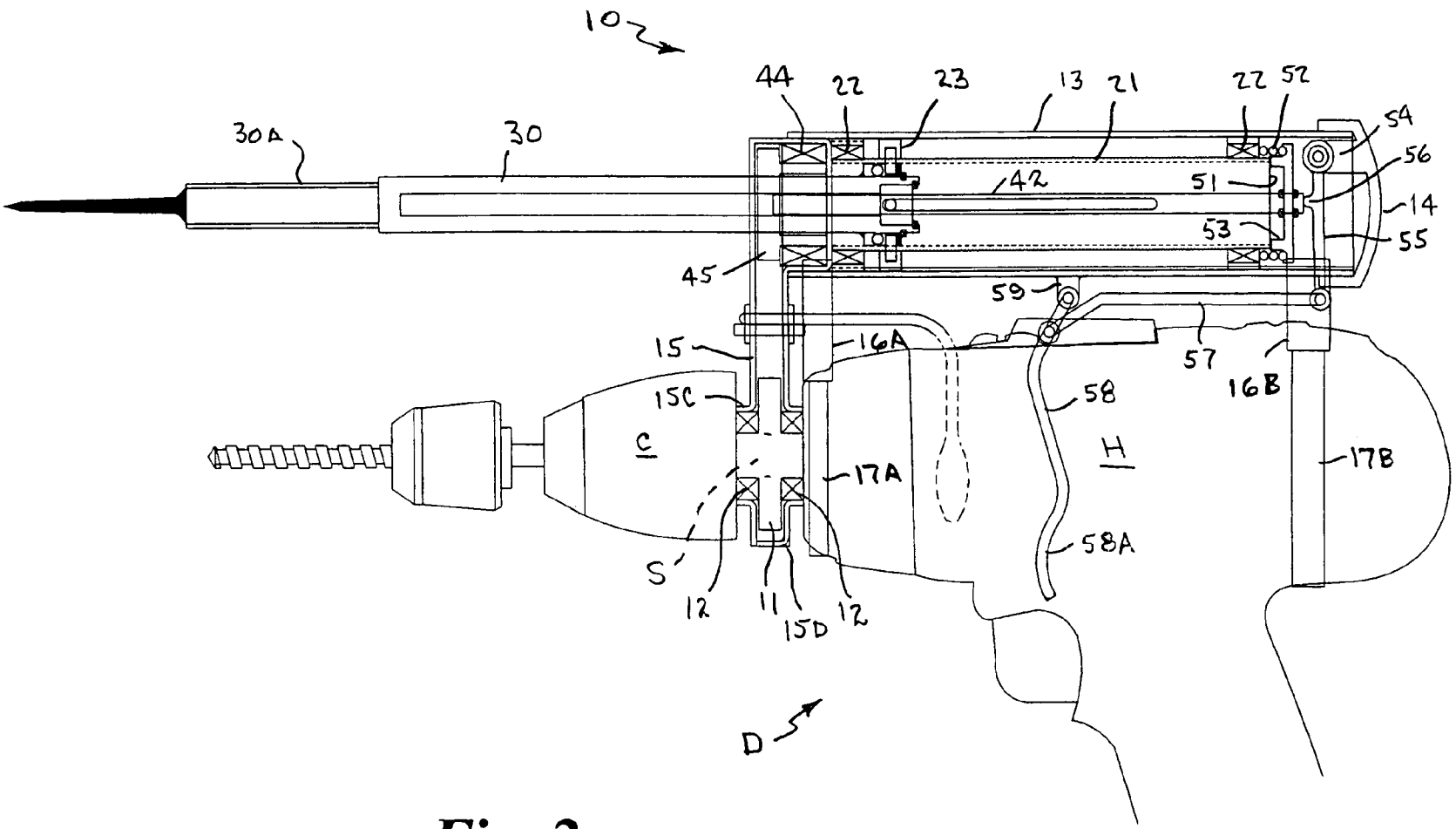
FIG. 2 is a side elevation of the mechanically operated apparatus shown with the auxiliary drive shaft in the extended position.

As shown in FIGS. 1 and 2, the present auxiliary rotary tool drive apparatus is typically used immediately after a hole is predrilled by the primary drive shaft of the power drill. To use the auxiliary rotary tool drive apparatus, the auxiliary drive shaft 30 with a screw pre-attached, is first extended beyond the drill bit clamped to the chuck C of the power drill by depressing the thumb lever 58 while the power drill is rotating in a clockwise direction. Depressing the thumb lever 58 pivots the drive plate lever 55, which engages the drive plate 49 with the tube plate 51. When the drive plate 49 and tube plate 51 are engaged, the extension tube 21 rotates in proportion and in the same direction as the hand drill.

As the extension tube 21 rotates, the threads of the extension tube 21 engage the threads of the screw ring 23. The screw ring 23 cannot rotate since the top and bottom channels 24 and 25 of the screw ring are engaged in the top and bottom ribs 20A and 20B on the interior of the elongate housing 13. Thus, the screw ring 23 travels longitudinally forward or rearward along the threaded length of the extension tube 21 as it rotates.

As the screw ring 23 travels longitudinally forward or rearward along the threaded length of the extension tube 21, it simultaneously moves the carrier plate 28, which is connected thereto by the carrier plate pins 27 captured in the screw ring inner groove 26.

As the carrier plate 28 moves forward or rearward on the extension tube 21, it moves the attached extendable portion of the drive rod 42, the auxiliary drive shaft 30, forward or rearward within the extension tube 21.

To stop extension of the auxiliary drive shaft 30, the thumb lever 58 is released or finger pressure on the trigger of the drill is released to stop the drill. To retract the auxiliary drive shaft 30, the rotation direction of the drill is reversed and the thumb lever 58 is depressed, and the drill is operated until retraction is completed.

Pneumatically Operated Embodiment

Referring now to FIGS. 10 through 17, there is shown a pneumatically operated embodiment of the auxiliary rotary tool drive apparatus 70. The components that are the same as the mechanically operated embodiment are assigned the same numerals of reference, but some of the components will not be described again in detail to avoid repetition.

As with the mechanically operated embodiment, the pneumatically operated auxiliary rotary tool drive apparatus 70 is mounted on, or an integral component of, and driven by, a rotary power tool, such as a hand-held power drill D having a housing H containing the usual gear drive train connected with a drive shaft S (spindle, or anvil) that extends forwardly from the housing and may or may not have a chuck C mounted at the outer end thereof. The gear drive train and other components within the drill housing are conventional and well known in the art, and therefore not shown or described in detail.

As with the previously described embodiment, the pneumatically operated auxiliary rotary tool drive apparatus 70 includes a primary drive gear 11 and a pair of primary gear bearings 12 at the front and rear of the primary drive gear which are shown, for purposes of example, installed on the drive shaft S (spindle or anvil) between the chuck C and the nose portion of the drill D.

The pneumatically operated apparatus 70 has an elongate generally cylindrical housing 73 enclosed at its rear end by an end wall 74 and has a drive gear case 75 secured at its front end (leftmost end as seen in the drawings). The elongate generally cylindrical housing 73 is attached to the top of the housing H of the power drill D by a front saddle 16A and a rear saddle 16B which are connected to the lower portion of the housing or case and securely fastened around the case or housing H of the power drill D by a front saddle strap 17A and rear saddle strap 17B.

Figure 12:
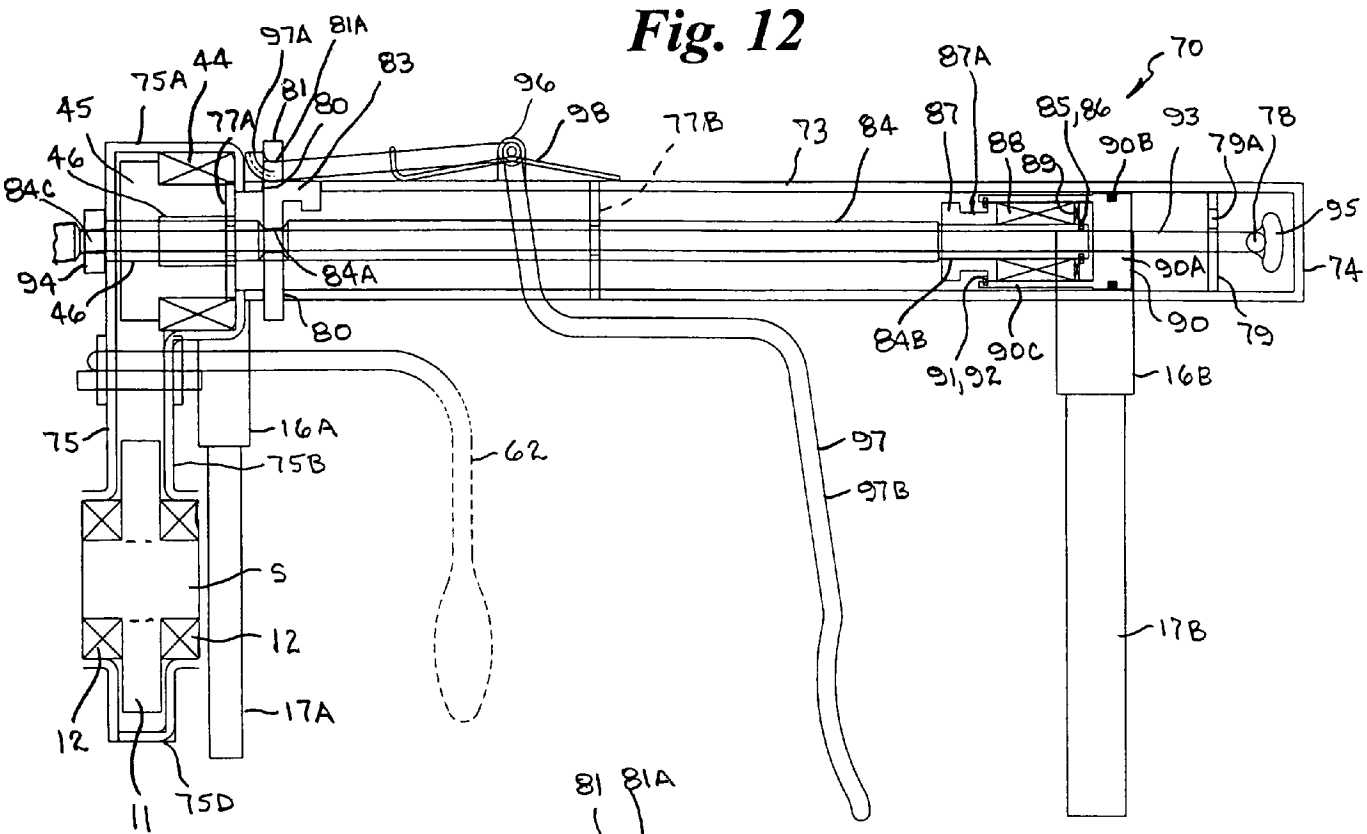
FIG. 12 is a longitudinal cross section through the pneumatically operated apparatus shown in larger scale with the auxiliary drive shaft retracted.
Figure 15:
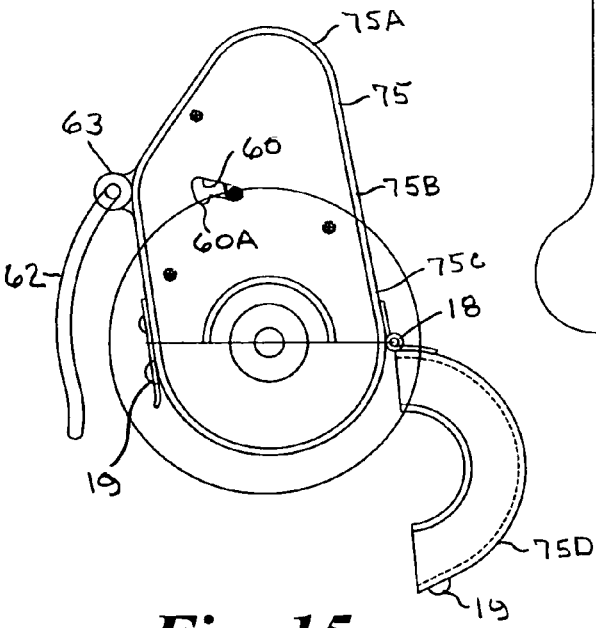
FIG. 15 is a cross sectional view of the drive gear case of the pneumatically operated apparatus with the lower segment in an unlatched position and the gears removed to more clearly show the horizontal slot having an arcuate recess at its outer end.

As best seen in FIGS. 12 and 15, the drive gear case 75 has a rearwardly protruding upper portion 75A that is secured to the front end of the elongate cylindrical housing 73, an intermediate portion 75B extending downwardly therefrom, and a segmented cylindrical lower portion with an upper segment 75C and a lower segment 75D connected on one side by a hinge 18 and a releasable latch mechanism 19 on the opposed sides. When the lower portion segments are latched, the lower portion 75D engages the primary gear bearings 12 and enclose the primary drive gear 11 and bearings that are installed on the drive shaft S (spindle or anvil) between the chuck C and the nose portion of the drill D. A horizontal slot 60 is disposed in or on the drive gear case 75 and has a depending arcuate recess 60A at an outer end configured to releasably engage the central shaft of an engagement gear contained in the intermediate portion 75B of the drive gear case, as described hereinafter.

A secondary drive gear bearing 44 is mounted in the upper end of the drive gear case 75, which is disposed in the front end of the elongate housing 73. A secondary drive gear 45 is contained in upper end of the drive gear case 75 and has a tubular neck portion rotatably supported in the secondary drive bearing 44. A hexagonal bore 46 extends through the center of the secondary drive gear 45 and the front portion of the auxiliary drive shaft 84, described hereinafter, extends through the hexagonal bore.

Figure 14:
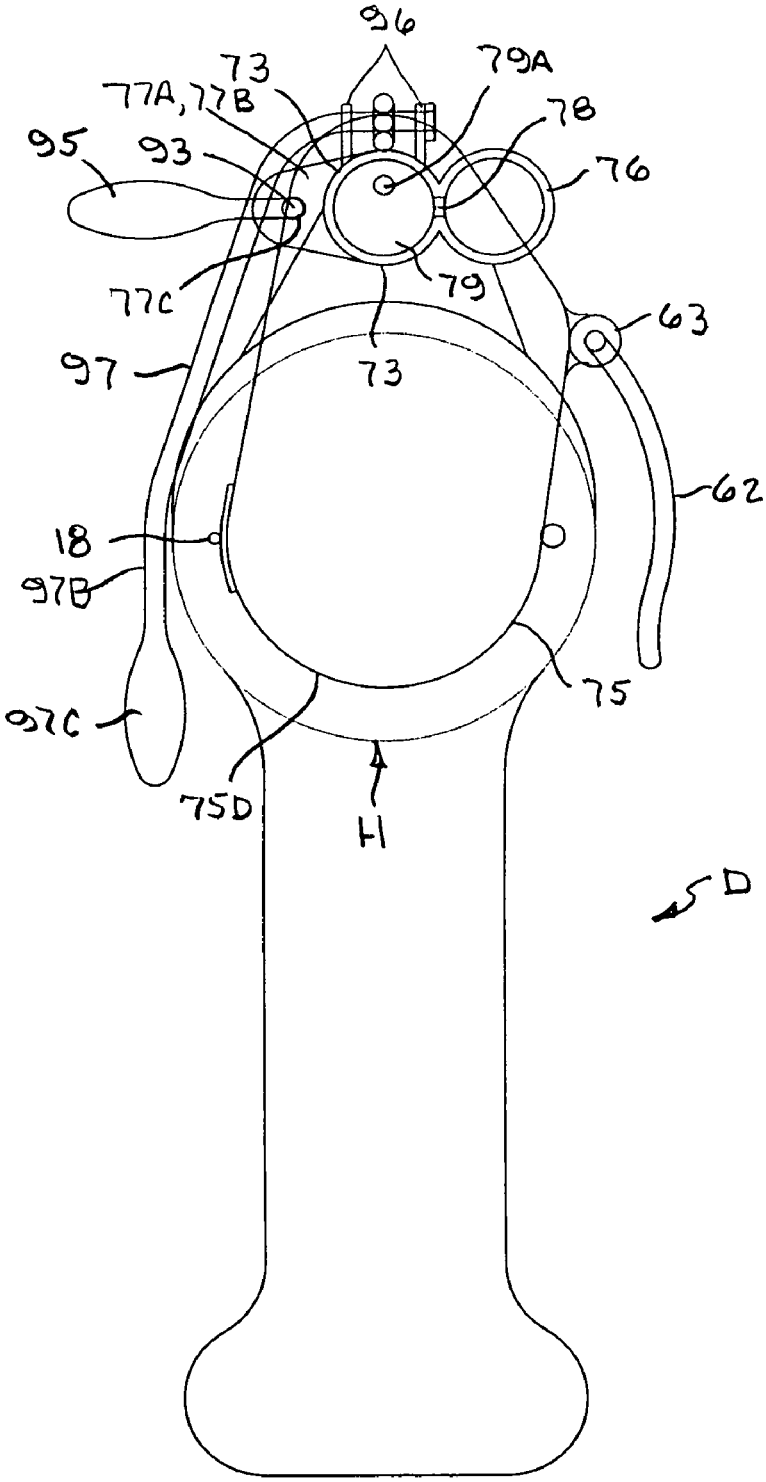
FIG. 14 is a front elevation view of the pneumatically operated apparatus installed on the hand-held drill, showing somewhat schematically, the housing, expansion tube and retractor rod.

As best seen in FIG. 14, an elongate tubular expansion tube 76 is secured laterally adjacent and parallel to the elongate cylindrical housing or case 73 by a first tube connector 77A and a second tube connector 77B such that their side walls are engaged tangentially. The outer ends of the tube connectors 77A, 77B are provided with holes 77C for slidably receiving a drive shaft retractor rod 93 (described hereinafter). The interior of the expansion tube 76 and elongate cylindrical housing 73 are joined in fluid exchange relation by a hole or passageway 78 passing through their side walls near their rear ends. A restrictor disc 79 having a small bore or orifice 79A is secured inside of the elongate housing or case 73 a short distance forward of the passageway 78. The restrictor orifice 79A serves to prevent the auxiliary drive shaft 84 (described hereinafter) from extending too quickly.

Figure 13:
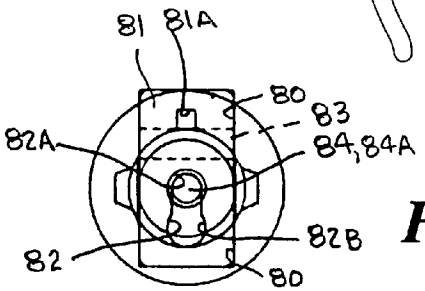
FIG. 13 is a cross sectional view through the housing showing the retention plate in its inwardly retracted position.

As best seen in FIGS. 12 and 13, the top and bottom of the of the elongate housing 73 are provided with vertically opposed transverse slots 80 disposed near the drive gear case 75, and a retention plate 81 is slidably received through the slots. The retention plate 81 has a generally hourglass or keyhole-shaped retaining slot 82 in its midsection which has a smaller semicircular top portion 82A and a larger semi-circular bottom portion 82B disposed in vertically spaced relation. The retention plate 81 has a generally L-shaped latch 83 with a short horizontal portion disposed above the top of the retaining slot 82 extending rearwardly from its back side terminating in a short depending vertical portion. The horizontal portion of the latch 83 is disposed inside the elongate housing 73. The top end of the shaft retention plate 81 extends a short distance upwardly from the transverse slots 80 at the top of the elongate housing 73 and the outwardly extended top end of the retention plate 81 is provided with a horizontal slot 81A for receiving the front end 97A of a retention plate lever 97 (described below).

An elongate hexagonal auxiliary drive shaft 84 extends through the center of the elongate housing or case 73. The front end of the auxiliary drive shaft 84 extends through the hexagonal bore 46 in the center of the secondary drive gear 45, and through the retaining slot 82 in the shaft retention plate 81, and is provided with a reduced diameter portion 84A near its front end which is axially aligned with the retaining slot 82 when the drive shaft is retracted.

The rear end of the drive shaft 84 has a reduced diameter portion 84B and a snap ring groove 85. A spool 87 having a reduced diameter portion 87A is received on the reduced diameter rear end portion 84B of the drive shaft 84. A drive shaft main bearing 88 and low-friction washer 89 are received on the reduced diameter rear portion 84B of the drive shaft 84 rearwardly of the spool 87 and secured by a snap ring 86 installed in the snap ring grove 85.

A piston 90 is mounted on the reduced diameter rear portion 84B of the drive shaft 84. The piston 90 has a cylindrical head portion 90A at its rear end with a circumferential seal 90B on its outer periphery engaged on the inside diameter of the elongate housing 73 in a sliding fluid sealing relation, and a hollow cylindrical skirt portion 90C extending forwardly from the head portion with a snap ring groove 91 on its interior diameter near its front end. The back end of the spool 87 and the drive shaft main bearing 88 are received and rotatably mounted within the interior diameter of the skirt portion 90C of the piston 90 and retained therein by a snap ring 92 installed in the snap ring groove 91.

The front end of the auxiliary drive shaft 84 that extends through the hexagonal bore 46 in the center of the secondary drive gear 45 extends outwardly from the front of the drive gear case 75 and is provided with a third reduced diameter portion 84C which is disposed closely adjacent to the drive gear case when the auxiliary drive shaft 84 is retracted.

An elongate drive shaft retractor rod 93 is slidably received and travels through the holes 77C in the tube connectors 77A, 77B. The front end of the drive shaft retractor rod 93 has laterally extending bracket 94 with a horizontal U-shaped opening that straddles the third reduced diameter portion 84C at the front end of the auxiliary drive shaft 84, and has a retractor handle 95 at its rear end for manually retracting the auxiliary drive shaft from an extended position.

A cylindrical screw holder 84D is shown at the front end of the auxiliary drive shaft 84, which is shown for purposes of example, adapted to hold a screw but which may be adapted to hold another fastener type or even an auxiliary working member.

A yoke 96 is mounted on the top of the elongate housing or case 73 rearwardly of the outwardly extending top end of the shaft retention plate 81. A retention plate lever 97 is pivotally mounted in the yoke 96 and has a forwardly extending portion with an upwardly curved front end 97A that is received in the horizontal slot 81A at the top end of the retention plate 81, a laterally extending portion extending outward from one side of the yoke 96, and a downwardly curved portion 97B that curves downwardly closely adjacent to the drill housing and terminates in a thumb rest portion 97C at its bottom end near the upper portion of the drill handgrip. A torsion spring 98 has one end engaged on the top of the elongate housing or case 73 rearwardly of the yoke 96 and its other end engaged on the forwardly extending portion of the retention plate lever 97 to normally maintain the forwardly extending portion of the retention plate lever and the retention plate 81 in a lowered position.

When the retention plate 81 is in the lowered position, the smaller semicircular top portion 82A of the retaining slot 82 in its midsection is engaged on the reduced diameter portion 84A near the front end of the auxiliary drive shaft 84 to prevent it from moving. When the thumb rest portion 97C at the lower end of the retention plate lever 97 is depressed, the lower portion of the retention plate lever 97 pivots forward and the forwardly extending portion 97A pivots upward against the pressure of the torsion spring 98 and raises the retention plate 81 to disengage the smaller semicircular top portion 82A of the retaining slot 82 from the reduced diameter portion 84A near the front end of the auxiliary drive shaft 84 to allow the drive shaft to pass slidably through the larger semi-circular bottom portion 82B of the retaining slot 82.

In the fully extended forward position, the reduced diameter portion 87A of the spool 87 near the rear end of the auxiliary drive shaft 84 is disposed beneath the depending leg of the generally L-shaped latch 83 of the retention plate 81, and when the thumb rest portion 97B at the lower end of the retention plate lever 97 is released, the retention plate 81 drops down to engage the depending leg of the latch 83 on the reduced diameter portion 87A of the spool 87 to prevent the auxiliary drive shaft 84 from being retracted.

Figure 16:
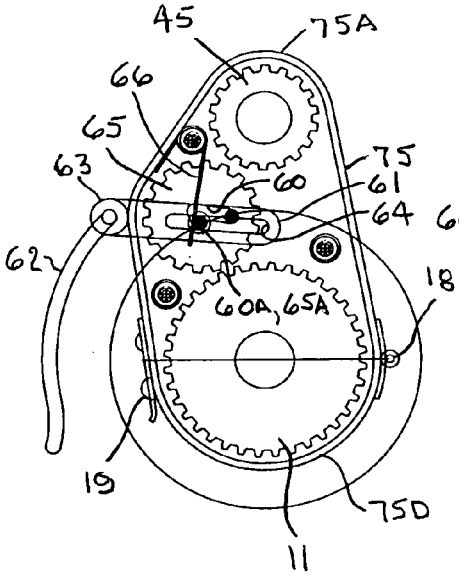
FIGS. 16 and 17 are cross sectional views of the drive gear case of the pneumatically operated apparatus showing somewhat schematically the transfer gear assembly in a disengaged position and an engaged position, respectively.
Figure 17:
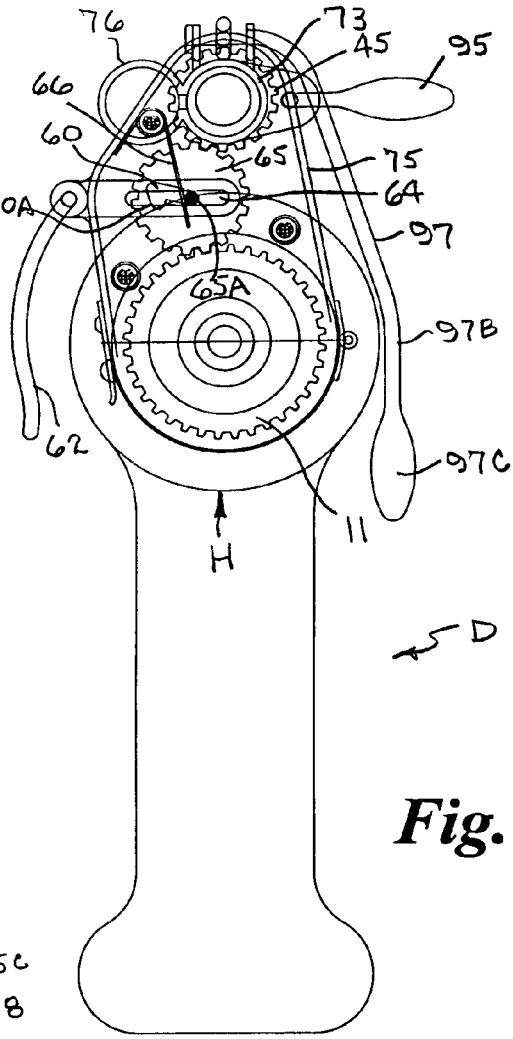

As with the previously described embodiment, and best seen in FIGS. 14, 16 and 17, a horizontal slot 60 is disposed in or on the drive gear case 75 and has a depending arcuate recess 60A at an outer end. A link 61 extends through the side of the drive gear case 75, and its outer end is connected to the horizontal leg of a generally L-shaped gear engagement lever 62 which extends rearwardly through a pivot connection 63 and downwardly along the side of the drill housing H and terminates near the trigger of the power drill. The inner facing end of the link 61 is provided with a slot 64 which is superposed in spaced relation over the horizontal slot 60.

An engagement gear 65 is disposed in the interior of the drive gear case 75 and has a central shaft 65A, one end of which is slidably and rotatably mounted in the horizontal slot 60 and the other end of which is slidably and rotatably mounted in the slot 64 of the link 61. A torsion spring 66 is fixed at one end to one side of the interior of the drive gear case 75, and its movable free end is engaged with the engagement gear shaft 65A to move the engagement gear 65.

In a disengaged position (FIG. 16), the inner facing end of the link 61 and its slot 64 extend downwardly at an angle with respect to a horizontal axis, and the central shaft 65A of the engagement gear 65 is retained in the arcuate recess 60A at the outer end of the horizontal slot 60 by the angularly disposed slot 64 of the link 61, thereby retaining the engagement gear 65 in a laterally outward disengaged position against the force of the torsion spring 66.

To engage the engagement gear 65 (FIG. 17), the gear engagement lever 62 is pivoted, and the link 61 pivots upwardly to a horizontal position and, as its slot 64 moves upwardly, it moves the central shaft 65A of the engagement gear 65 out of the arcuate recess 60A of the horizontal slot 60, and when the slots are aligned, the force of the torsion spring 66 moves the engagement gear 65 inwardly to engage its teeth with the teeth of the primary drive gear 11 and the secondary drive gear 45.

Operation of the Pneumatically Operated Embodiment

Figure 10:
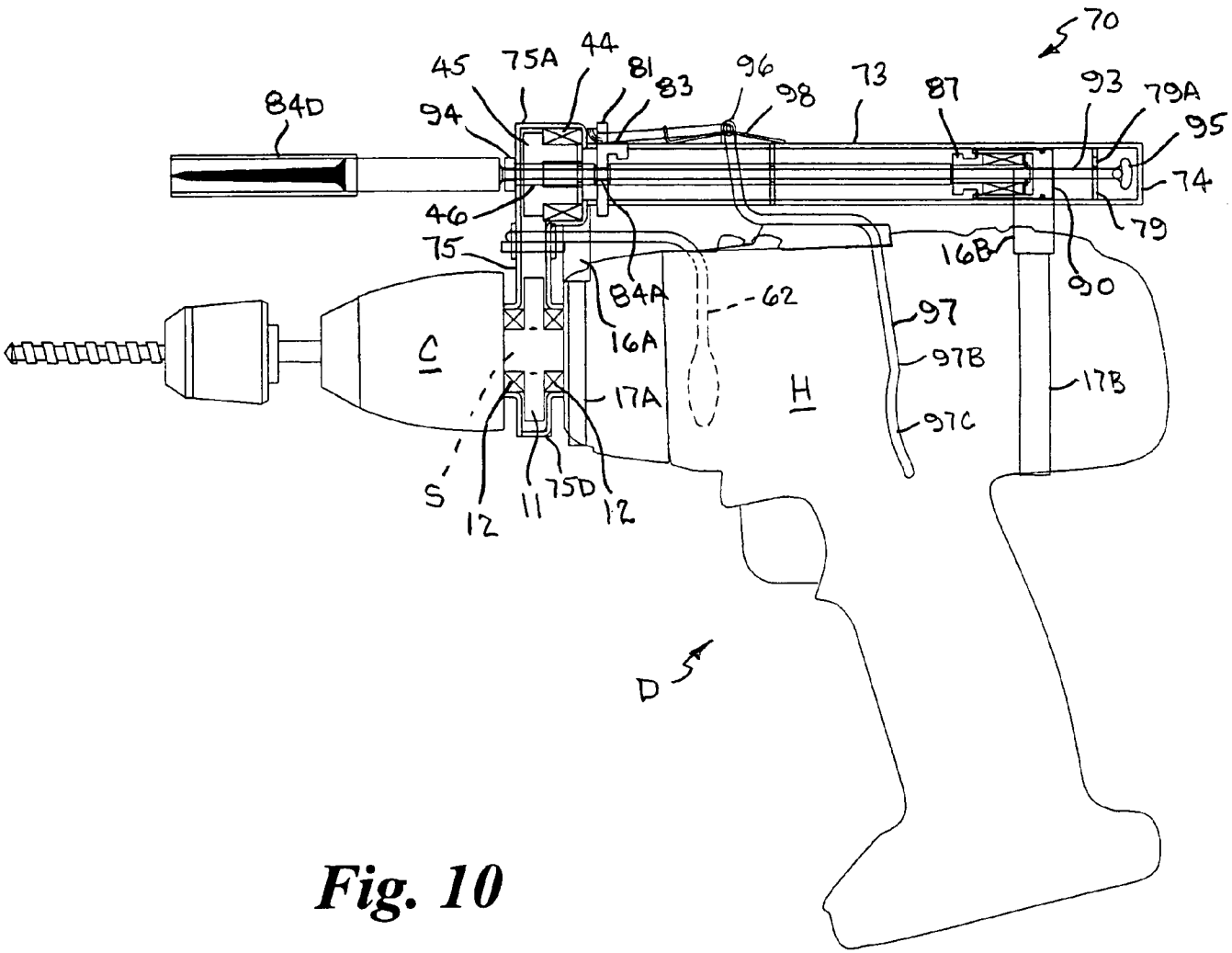
FIG. 10 is a side elevation of a pneumatically operated auxiliary rotary tool drive apparatus in accordance with a second embodiment the present invention, shown attached to a hand-held power drill and with the auxiliary drive shaft in the retracted position.
Figure 11:
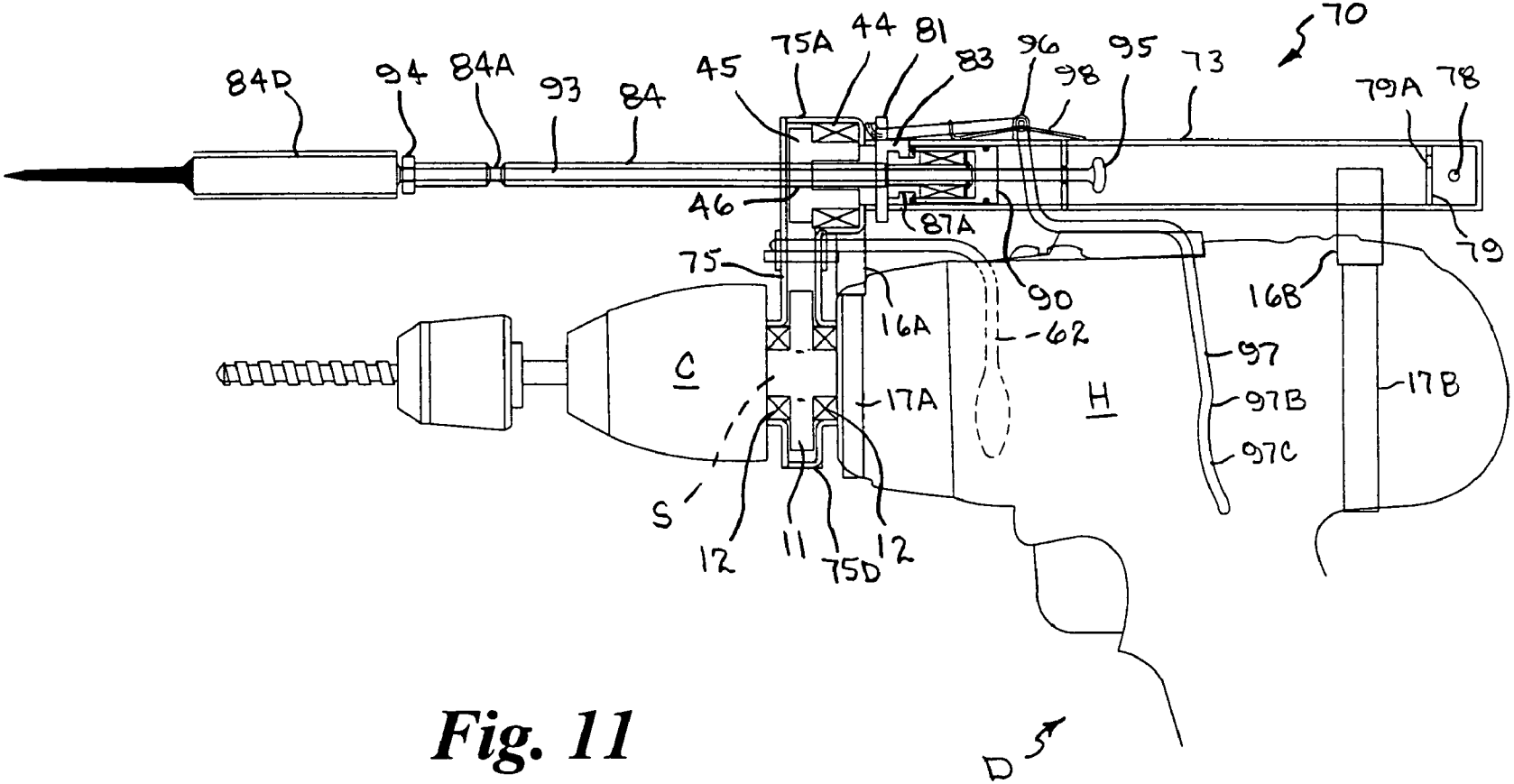
FIG. 11 is a side elevation of the pneumatically operated apparatus with the auxiliary drive shaft in the extended position.

Referring now to FIGS. 10, 11, and 12, the primary drive gear 11 is first installed on the drive shaft S (spindle or anvil) of the drill D between the chuck C and the nose portion of the standard power drill. Next, the apparatus 70 is installed on top of the drill housing H by mounting the front and rear saddles 16A and 16B on the top of the power drill, and securing the front and rear saddle straps 17A and 17B around the drill housing. The lower segment 75D of the drive gear case 75 is then closed around the primary drive gear 11 and latched by the latch 19.

As seen in FIGS. 16 and 17, and described above, when the gear engagement lever 62 is pivoted, the engagement gear 65 is lifted and spring biased inwardly into tooth-to-tooth engagement with the primary drive gear 11 and secondary drive gear 45, which transfer the rotation of the primary drive shaft S of the drill to the secondary drive gear 45. The secondary drive gear 45 only rotates when the engagement gear 65 is engaged and the primary drive shaft S of the drill is rotating in either forward or reverse directions.

Air is sealingly contained in the elongate cylindrical housing 73 in the area behind the piston 90 and in the expansion tube 76 which is in fluid communication therewith through the passageway 78. The air becomes compressed when the auxiliary drive shaft 84 and piston 90 are moved to the retracted position and acts as a pneumatic spring when the auxiliary drive shaft is released to drive it forward.

As shown in FIGS. 10, 11 and 12, the present auxiliary rotary tool drive apparatus is typically used immediately after a hole is predrilled by the primary drive shaft of the power drill. As described above, the interior of the expansion tube 76 and elongate cylindrical housing or case 73 are in fluid exchange relation via the hole or passageway 78 passing through their side walls, and air is metered through the small bore or orifice 79A in the restrictor disc 79 inside the housing 73 to prevent the drive shaft 84 from extending too quickly.

To use the auxiliary rotary tool drive apparatus 70, the auxiliary drive shaft 84 with a screw pre-attached, is first extended beyond the drill bit clamped to the chuck C of the power drill by depressing the retention plate lever 97 to raise the retention plate 81 and disengage the smaller semicircular top portion 82A of the retaining slot 82 from the reduced diameter portion 84A near the front end of the auxiliary drive shaft 84, allowing the metered air pressure to drive the piston 90 and auxiliary drive shaft 84 forward through the larger semi-circular bottom portion 82B of the retaining slot 82, also carrying the drive shaft retractor rod 93 forward with it. When the auxiliary drive shaft 84 reaches its fully extended forward position, the retention plate lever 97 is released to lower the retention plate 81 and engage the depending leg of the latch 83 on the reduced diameter portion 87A of the spool 87 to prevent the auxiliary drive shaft 84 from being retracted.

To retract the auxiliary drive shaft 84, the retention plate lever 97 is depressed to raise the retention plate 81 and disengage engage the depending leg of the latch 83 from the reduced diameter portion 87A of the spool 87, the drive shaft retractor rod 93 is manually pulled rearward by the handle 95 at its rear end, and the retention plate lever 97 is released to drop the retention plate 81 and engage the smaller semicircular top portion 82A of the retaining slot 82 on the reduced diameter portion 84A near the front end of the auxiliary drive shaft 84, to prevent movement of the auxiliary drive shaft.

Although the present mechanically and pneumatically operated auxiliary rotary tool drive apparatuses have been described, for purposes of example, as being attached to an existing conventional rotary power tool, such as a conventional power drill, it should be understood that the present mechanically and pneumatically operated auxiliary rotary tool drive mechanisms may be incorporated as integral components of the rotary power tool.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. An auxiliary rotary tool drive apparatus for attachment to a hand-held rotary power tool of the type having a housing with a handgrip, a trigger, and a rotary power transmitting shaft bearing a work performing member, the auxiliary rotary tool drive apparatus comprising:

an elongate auxiliary housing enclosed at a rear end;

mounting means for mounting said auxiliary housing to the rotary power tool housing;

an elongate auxiliary drive shaft having a longitudinal axis oriented parallel with the rotary power transmitting shaft of the rotary power tool wherein said auxiliary drive shaft is rotatably and reciprocally mounted in said auxiliary housing for movement between a rearward retracted position and a forward extended position;

reciprocating drive means including converting means connected with said auxiliary drive shaft for causing linear movement of said auxiliary drive shaft between said rearward retracted position and said forward extended position responsive to rotation of said auxiliary drive shaft;

auxiliary holding means at a front portion of said auxiliary drive shaft for holding a selected screw or other type fastener, a bit, or other auxiliary work performing member;

a selectively engageable drive mechanism connected with the rotary power tool power transmitting shaft engageable with said auxiliary drive shaft for transferring rotary motion from the power transmitting shaft to said auxiliary drive shaft in an engaged position; wherein in the retracted position, said auxiliary holding means holding said selected screw or other type fastener, bit, or other auxiliary work performing member rearward of said work performing member of said power transmitting shaft so as not to interfere with its normal operations, and in the extended position, said auxiliary holding means holding said selected screw or other type fastener, bit, or other work performing member forward of said work performing member of said power transmitting shaft so as to allow operation of said auxiliary drive shaft unimpeded by said work performing member of said power transmitting shaft; whereby a user may carry out normal operations with said rotary power tool and use said auxiliary drive shaft for the application of screws or other type fasteners, bits, or other auxiliary work performing members without removal or replacement of the work performing member held in said holding member of said rotary power tool.

2. The auxiliary rotary tool drive apparatus according to claim 1, wherein said mounting means comprises a front strap and rear strap secured around the rotary power tool housing.

3. The auxiliary rotary tool drive apparatus according to claim 1, wherein said mounting means comprises a front saddle and a rear saddle adapted to be received on the exterior of the rotary power tool housing and connected with said elongate generally cylindrical auxiliary housing and attached to the rotary power tool housing by a front strap and rear strap secured around the rotary power tool housing.

4. The auxiliary rotary tool drive apparatus according to claim 1, wherein said selectively engageable drive mechanism comprises a drive gear case containing a gear assembly including a primary drive gear adapted to be mounted on the rotary power tool power transmitting shaft, a secondary drive gear engaged on said front portion of said auxiliary drive shaft, and a movable engagement gear selectively engageable between said primary drive gear and said secondary drive gear.

5. The auxiliary rotary tool drive apparatus according to claim 4, wherein said drive gear case has an upper portion engaged with the front end of said auxiliary housing and covering said secondary drive gear mounted on said auxiliary drive shaft, an intermediate portion extending downwardly in which said engagement gear is movably and rotatably disposed, and a lower portion having an upper segment and a lower segment hingedly connected on one side and a releasable latch mechanism on opposed sides, such that when the segments are latched, said lower portion enclose said primary drive gear mounted on the rotary power tool power transmitting shaft.

6. The auxiliary rotary tool drive apparatus according to claim 4, further comprising:

gear engagement linkage connected with said engagement gear for moving said engagement gear relative to said primary drive gear and said secondary drive gear between a normally disengaged position preventing rotation of said secondary drive gear and said auxiliary drive shaft and an engaged position engaged between said primary drive gear and said secondary drive gear to transfer rotary motion from the rotary power tool power transmitting shaft to said auxiliary drive shaft; and an engagement lever pivotally connected with said gear engagement linkage means having a free end disposed adjacent to the rotary power tool handle for receiving the thumb or finger of a user, said engagement lever when manually pivoted rearward moves said engagement gear into said engaged position and when released, allows said engagement gear to assume said disengaged position; whereby rotary motion of the auxiliary drive may be selectively controlled by the thumb or finger of the same hand of the user holding the rotary power tool by the handgrip.

7. The auxiliary rotary tool drive apparatus according to claim 6, further comprising:

an actuating lever pivotally connected with said reciprocating drive means and said converting means having a free end disposed adjacent to the rotary power tool handle for receiving the thumb or finger of the user;

said actuating lever when manually pivoted rearward engages said reciprocating drive means and said converting means with said auxiliary drive shaft, and rotary motion of said auxiliary drive shaft causes linear movement of said auxiliary drive shaft between said rearward retracted position and said forward extended position, and when released, disengages said converting means to stop linear movement while allowing rotation of said auxiliary drive shaft; whereby reciprocating movement of said auxiliary drive shaft between said rearward retracted position and said forward extended position may be selectively controlled by the thumb or finger of the same hand of the user holding the rotary power tool by the handgrip.

8. The auxiliary rotary tool drive apparatus according to claim 7, wherein said reciprocating drive means and said converting means comprise:

a top ridge rib and a bottom rib extending longitudinally along the interior of said auxiliary housing at the top and bottom thereof, respectively, in vertically opposed relation;

an externally threaded extension tube rotatably supported at front and rear ends within said auxiliary housing on front and rear bearings;

an internally threaded screw ring threadedly engaged on said extension tube and having a top channel and a bottom channel disposed in vertically opposed relation in its circumference slidably received on and said top and bottom ribs, respectively, such that upon rotation of said extension tube, said screw ring is prevented from rotation by said ribs and caused to travel linearly along the threaded length of said extension tube;

said screw ring having an interior annular U-shaped inner groove with an opening facing the center of said screw ring;

a carrier plate and a retaining ring mounted on said auxiliary drive shaft having opposed facing arcuate recesses with a plurality of ball bearings rotatably contained between the arcuate recesses and surrounding the exterior of said auxiliary drive shaft;

a plurality of carrier plate pins having opposed ends rotatably received in said screw ring inner groove and said carrier plate, respectively;

a hexagonal recess at the rear end of said auxiliary drive shaft and a drive transfer nut having a hexagonal exterior and central hexagonal bore retained in said hexagonal recess;

an elongate longitudinal bore extending a distance inwardly from a rear end of said auxiliary drive shaft;

a hexagonal drive rod having a front portion extending slidably through said drive nut central hexagonal bore and received in said auxiliary drive shaft elongate longitudinal bore, and a rear end extending rearward from the rear end of said auxiliary drive shaft;

a drive plate mounted on said rear end said drive rod and having a tubular extension;

a tube plate having a central opening secured to the back end of said extension tube;

a compression spring surrounding a rear end of said extension tube having one end engaged on said rear bearing supporting said extension tube and its opposed end engaged on said drive plate tubular extension;

a drive plate lever pivotally mounted at a top end in said enclosed end of said auxiliary housing having a protrusion for engaging the back end of said drive rod;

an actuation rod connected at a rear end to a bottom end of said drive plate lever and at a front end to said actuating lever;

said actuating lever pivotally connected at a top end to the underside of said auxiliary housing and extending laterally outward and downwardly closely adjacent to the rotary power tool housing terminating at said free end; whereby said actuating lever when manually pivoted rearward carries said actuation rod forward, which pivots said drive plate lever forward engaging its said protrusion on said back end of said drive rod driving it forward, which drives said drive plate forward against the pressure of said compression spring to engage its said tubular extension on said tube plate at the back end of said extension tube.

9. The auxiliary rotary tool drive apparatus according to claim 8, wherein to move said auxiliary drive shaft to said forward extended position, said drive plate tubular extension is engaged with said tube plate, said extension tube rotates in proportion and in the same direction as the rotary power tool drive shaft, and as said externally threaded extension tube rotates, said screw ring threadedly engaged thereon travels longitudinally forward along the threaded length of said extension tube as it rotates, and simultaneously moves said carrier plate connected thereto by said carrier plate pins longitudinally forward, and as said carrier plate moves forward on said extension tube, it moves said drive rod forward, which drives said auxiliary drive shaft forward; and forward movement is stopped when said when said actuating thumb lever is released or when finger pressure on the trigger of the rotary power tool is released; and to move said auxiliary drive shaft to the rearward retracted position, the rotation direction of the rotary power tool drive shaft is reversed and said actuating lever depressed, and the rotary power tool is operated until retraction is completed.

10. The auxiliary rotary tool drive apparatus according to claim 6, further comprising:

an elongate tubular expansion tube secured adjacent to said auxiliary housing, the interior of said expansion tube and interior of said auxiliary housing being joined in fluid exchange relation by a fluid passageway near their rear ends, and a fluid restrictor disc having a small orifice secured in said expansion tube a short distance forward of said fluid passageway;

a piston rotatably mounted on a back end of said auxiliary drive shaft and having a circumferential seal engaged on the interior of said auxiliary housing in a reciprocating rotary fluid sealing relation, and a spool having a reduced diameter exterior portion mounted on said auxiliary drive shaft forward of said piston;

retention means selectively engageable with said auxiliary drive shaft for allowing linear movement of said auxiliary drive shaft between said rearward retracted position and said forward extended position and retaining said auxiliary drive shaft in either of said rearward retracted position or said forward extended position while allowing rotation thereof; and a retention lever having a free end disposed adjacent to the rotary power tool handle for receiving the thumb or finger of the user and operatively connected with said retention means for selectively engaging and disengaging said auxiliary drive shaft; whereby extension of said auxiliary drive shaft from said rearward retracted position to said forward extended position may be selectively controlled by the thumb or finger of the same hand of the user holding the rotary power tool by the handgrip.

11. The auxiliary rotary tool drive apparatus according to claim 10, wherein said auxiliary drive shaft has a reduced diameter portion near its front end; and said retention means comprises a retention plate having a first end extending slidably through a slot near said front end of said auxiliary housing with a slot in said first end, said retention plate movable between an outwardly extended position and an inwardly retracted position and having a retaining slot in a midsection through which said auxiliary drive shaft extends configured to engage said reduced diameter of said auxiliary drive shaft in the inwardly retracted position and disengage said reduced diameter in the outwardly extended position, and said retention plate having a latch element disposed to engage said reduced diameter of said spool on said auxiliary drive shaft in the inwardly retracted position and disengage said spool reduced diameter in the outwardly extended position;

said retention lever pivotally mounted on said auxiliary housing and having a forward extending portion received in said slot in said first end of said retention plate, a midportion extending laterally outward from said pivotal mounting and a lower portion extending downwardly closely adjacent to the rotary power tool housing terminating at said free end; and a torsion spring having a first end engaged on said auxiliary housing and a second end engaged on said forwardly extending portion of said retention lever to normally maintain said retention plate in the inwardly retracted position with its said retaining slot engaged with said reduced diameter of said auxiliary drive shaft; wherein said retaining slot of said retention plate is engaged on said auxiliary drive shaft reduced diameter portion near its front end when said retention plate is the inwardly retracted position to prevent axial movement of said auxiliary drive shaft while allowing rotation thereof; and said retention lever when manually pivoted rearward pivots said forwardly extending portion of said retention lever against the pressure of said torsion spring to move said retention plate slot to the outwardly extended position and disengage said retaining slot from said reduced diameter of said auxiliary drive shaft to allow said auxiliary drive shaft to pass slidably through said retention plate retaining slot, such that said auxiliary drive shaft is driven slowly forward by fluid pressure metered through said restriction plate orifice into the area behind said piston;

when said auxiliary drive shaft is in the fully extended forward position, said reduced diameter portion of said spool is disposed beneath said retention plate latch element; and when said retention lever is released, said retention plate is moved by the force of said torsion spring to its inwardly retracted position to engage said latch element with said spool reduced diameter portion to prevent said auxiliary drive shaft from being retracted.

12. The auxiliary rotary tool drive apparatus according to claim 11, further comprising:

retraction means operatively connected with said auxiliary drive shaft for retracting said auxiliary drive shaft from the fully extended forward position.

13. The auxiliary rotary tool drive apparatus according to claim 12, wherein said retraction means comprises an elongate retraction rod slidably mounted adjacent to said auxiliary housing having a front end engaged with a forward end of said auxiliary drive shaft adjacent to said tool holding means at the front end thereof such that said retraction rod moves axially with said auxiliary drive shaft between a forward extended position and a rearward retracted position and having a handle or knob at a second end to be gripped by the user; whereby said auxiliary drive shaft may be manually retracted by the user pivoting said retention lever to move said retention plate slot to the outwardly extended position and disengage said latch element from said spool reduced diameter portion and pulling said retraction rod rearwardly, and thereafter releasing said retention lever to allow said retention plate to be moved by the force of said torsion spring to its inwardly retracted position such that said retaining slot of said retention plate is engaged on said auxiliary drive shaft reduced diameter portion near its front end.

14. A hand-held rotary power tool having an auxiliary rotary tool drive shaft, comprising:

a hand-held rotary power tool having a housing, a handgrip, a trigger on said handgrip, rotary drive means in said housing, and a primary rotary power transmitting shaft connected with said rotary drive means to be rotated thereby, said primary rotary power transmitting shaft having a first end extending from said housing and a holding member at an outer end thereof for holding a work performing member; and an elongate generally cylindrical auxiliary housing connected with said rotary power tool housing;

an elongate auxiliary drive shaft having a longitudinal axis oriented parallel with said primary rotary power transmitting shaft of said rotary power tool rotatably and reciprocally mounted in said auxiliary housing for movement between a rearward retracted position and a forward extended position;

reciprocating drive means including converting means connected with said auxiliary drive shaft for causing linear movement of said auxiliary drive shaft between said rearward retracted position and said forward extended position responsive to rotation of said auxiliary drive shaft;

auxiliary holding means at a front portion of said auxiliary drive shaft for holding a selected screw or other type fastener, a bit, or other auxiliary work performing member;

a selectively engageable drive mechanism connected with said rotary power tool power transmitting shaft engageable with said auxiliary drive shaft for transferring rotary motion from the power transmitting shaft to said auxiliary drive shaft in an engaged position; wherein in the retracted position, said auxiliary holding means holding said selected screw or other type fastener, bit, or other auxiliary work performing member rearward of said work performing member held by said power transmitting shaft so as not to interfere with its normal operations, and in the extended position, said auxiliary holding means holding said selected screw or other type fastener; bit, or other auxiliary work performing member forward of said work performing member held by said power transmitting shaft so as to allow operation of said auxiliary drive shaft unimpeded by said work performing member held by said power transmitting shaft; whereby a user may carry out normal operations with said rotary power tool and use said auxiliary rotary tool drive shaft for the application of screws or other type fasteners, bits, or other auxiliary work performing members without removal or replacement of the work performing member held in said holding member of said power transmitting shaft.

15. The rotary power tool apparatus according to claim 14, wherein an auxiliary drive gear assembly including a primary drive gear mounted on said rotary power tool power transmitting shaft, a secondary drive gear engaged on a front portion of said auxiliary drive shaft, and a movable engagement gear selectively engageable between said primary drive gear and said secondary drive gear for transferring rotary motion from said rotary power tool power transmitting shaft to said auxiliary drive shaft in an engaged position.

16. The rotary power tool according to claim 15, further comprising:

gear engagement linkage means connected with said engagement gear for moving said engagement gear relative to said primary drive gear and said secondary drive gear between a normally disengaged position preventing rotation of said secondary drive gear and said auxiliary drive shaft and an engaged position engaged between said primary drive gear and said secondary drive gear to transfer rotary motion from said rotary power tool power transmitting shaft to said auxiliary drive shaft; and an engagement lever pivotally connected with said gear engagement linkage means having a free end disposed adjacent to said rotary power tool handle for receiving the thumb or finger of a user, said engagement lever when manually pivoted rearward moves said engagement gear into said engaged position and when released, allows said engagement gear to assume said disengaged position; whereby rotary motion of said auxiliary drive shaft may be selectively controlled by the thumb or finger of the same hand of the user holding said rotary power tool by the handgrip.

17. The rotary power tool according to claim 16, further comprising:

an actuating lever pivotally connected with said reciprocating drive means and said converting means having a free end disposed adjacent to said rotary power tool handle for receiving the thumb or finger of the user;

said actuating lever when manually pivoted rearward engages said reciprocating drive means and said converting means with said auxiliary drive shaft, and rotary motion of said auxiliary drive shaft causes linear movement of said auxiliary drive shaft between said rearward retracted position and said forward extended position, and when released, disengages said converting means to stop linear movement while allowing rotation of said auxiliary drive shaft; whereby reciprocating movement of said auxiliary drive shaft between said rearward retracted position and said forward extended position may be selectively controlled by the thumb or finger of the same hand of the user holding said rotary power tool by the handgrip.

18. The rotary power tool according to claim 17, wherein said reciprocating drive means and said converting means comprise:

a top ridge rib and a bottom rib extending longitudinally along the interior of said auxiliary housing at the top and bottom thereof, respectively, in vertically opposed relation;

an externally threaded extension tube rotatably supported at front and rear ends within said auxiliary housing on front and rear bearings;

an internally threaded screw ring threadedly engaged on said extension tube and having a top channel and a bottom channel disposed in vertically opposed relation in its circumference slidably received on and said top and bottom ribs, respectively, such that upon rotation of said extension tube, said screw ring is prevented from rotation by said ribs and caused to travel linearly along the threaded length of said extension tube;

said screw ring having an interior annular U-shaped inner groove with an opening facing the center of said screw ring;

a carrier plate and a retaining ring mounted on said auxiliary drive shaft having opposed facing arcuate recesses with a plurality of ball bearings rotatably contained between the arcuate recesses and surrounding the exterior of said auxiliary drive shaft;

a plurality of carrier plate pins having opposed ends rotatably received in said screw ring inner groove and said carrier plate, respectively;

a hexagonal recess at the rear end of said auxiliary drive shaft and a drive transfer nut having a hexagonal exterior and central hexagonal bore retained in said hexagonal recess;

an elongate longitudinal bore extending a distance inwardly from a rear end of said auxiliary drive shaft;

a hexagonal drive rod having a front portion extending slidably through said drive nut central hexagonal bore and received in said auxiliary drive shaft elongate longitudinal bore, and a rear end extending rearward from the rear end of said auxiliary drive shaft;

a drive plate mounted on said rear end said drive rod and having a tubular extension;

a tube plate having a central opening secured to the back end of said extension tube;

a compression spring surrounding a rear end of said extension tube having one end engaged on said rear bearing supporting said extension tube and its opposed end engaged on said drive plate tubular extension;

a drive plate lever pivotally mounted at a top end in said enclosed end of said auxiliary housing having a protrusion for engaging the back end of said drive rod;

an actuation rod connected at a rear end to a bottom end of said drive plate lever and at a front end to said actuating lever;

said actuating lever pivotally connected at a top end to the underside of said auxiliary housing and extending laterally outward and downwardly closely adjacent to the said rotary power tool housing terminating at said free end; whereby said actuating lever when manually pivoted rearward carries said actuation rod forward, which pivots said drive plate lever forward engaging its said protrusion on said back end of said drive rod driving it forward, which drives said drive plate forward against the pressure of said compression spring to engage its said tubular extension on said tube plate at the back end of said extension tube.

19. The rotary power tool according to claim 18, wherein to move said auxiliary drive shaft to said forward extended position, said drive plate tubular extension is engaged with said tube plate, said extension tube rotates in proportion and in the same direction as said primary power transmitting shaft of said power tool, and as said externally threaded extension tube rotates, said screw ring threadedly engaged thereon travels longitudinally forward along the threaded length of said extension tube as it rotates, and simultaneously moves said carrier plate connected thereto by said carrier plate pins longitudinally forward, and as said carrier plate moves forward on said extension tube, it moves said drive rod forward, which drives said auxiliary drive shaft forward; and forward movement is stopped when said when said actuating lever is released or when finger pressure on said trigger of said rotary power tool is released; and to move said auxiliary drive shaft to the rearward retracted position, the rotation direction of the primary power transmitting shaft of the power tool is reversed and said actuating lever depressed, and said rotary power tool is operated until retraction is completed.

20. The rotary power tool according to claim 16, further comprising:

an elongate tubular expansion tube secured adjacent to said auxiliary housing, the interior of said expansion tube and interior of said auxiliary housing being joined in fluid exchange relation by a fluid passageway near their rear ends, and a fluid restrictor disc having a small orifice secured in said expansion tube a short distance forward of said fluid passageway;

a piston rotatably mounted on a back end of said auxiliary drive shaft and having a circumferential seal engaged on the interior of said auxiliary housing in a reciprocating rotary fluid sealing relation, and a spool having a reduced diameter exterior portion mounted on said auxiliary drive shaft forward of said piston;

retention means selectively engageable with said auxiliary drive shaft for allowing linear movement of said auxiliary drive shaft between said rearward retracted position and said forward extended position and retaining said auxiliary drive shaft in either of said rearward retracted position or said forward extended position while allowing rotation thereof; and a retention lever having a free end disposed adjacent to said rotary power tool handle for receiving the thumb or finger of the user and operatively connected with said retention means for selectively engaging and disengaging said auxiliary drive shaft; whereby extension of said auxiliary drive shaft from said rearward retracted position to said forward extended position may be selectively controlled by the thumb or finger of the same hand of the user holding said rotary power tool by the handgrip.

21. The rotary power tool according to claim 20, wherein said auxiliary drive shaft has a reduced diameter portion near its said front end; and said retention means comprises a retention plate having a first end extending slidably through a slot near said front end of said auxiliary housing with a slot in said first end, said retention plate movable between an outwardly extended position and an inwardly retracted position and having a retaining slot in a midsection through which said auxiliary drive shaft extends configured to engage said reduced diameter of said auxiliary drive shaft in the inwardly retracted position and disengage said reduced diameter in the outwardly extended position, and said retention plate having a latch element disposed to engage said reduced diameter of said spool on said auxiliary drive shaft in the inwardly retracted position and disengage said spool reduced diameter in the outwardly extended position;

said retention lever pivotally mounted on said auxiliary housing and having a forward extending portion received in said slot in said first end of said retention plate, a midportion extending laterally outward from said pivotal mounting and a lower portion extending downwardly closely adjacent to said rotary power tool housing terminating at said free end; and a torsion spring having a first end engaged on said auxiliary housing and a second end engaged on said forwardly extending portion of said retention lever to normally maintain said retention plate in the inwardly retracted position with its said retaining slot engaged with said reduced diameter of said auxiliary drive shaft; wherein said retaining slot of said retention plate is engaged on said auxiliary drive shaft reduced diameter portion near its front end when said retention plate is the inwardly retracted position to prevent axial movement of said auxiliary drive shaft while allowing rotation thereof; and said retention lever when manually pivoted rearward pivots said forwardly extending portion of said retention lever against the pressure of said torsion spring to move said retention plate slot to the outwardly extended position and disengage said retaining slot from said reduced diameter of said auxiliary drive shaft to allow said auxiliary drive shaft to pass slidably through said retention plate retaining slot, such that said auxiliary drive shaft is driven slowly forward by fluid pressure metered through said restriction plate orifice into the area behind said piston;

when said auxiliary drive shaft is in the fully extended forward position, said reduced diameter portion of said spool is disposed beneath said retention plate latch element; and when said retention lever is released, said retention plate is moved by the force of said torsion spring to its inwardly retracted position to engage said latch element with said spool reduced diameter portion to prevent said auxiliary drive shaft from being retracted.

22. The rotary power tool according to claim 21, further comprising:

retraction means operatively connected with said auxiliary drive shaft for retracting said auxiliary drive from the fully extended forward position.

23. The rotary power tool according to claim 22, wherein said retraction means comprises an elongate retraction rod slidably mounted adjacent to said auxiliary housing having a front end engaged with a forward end of said auxiliary drive shaft adjacent to said tool holding means at the front end thereof such that said retraction rod moves axially with said auxiliary drive shaft between a forward extended position and a rearward retracted position and having a handle at a second end to be gripped by the user; whereby said auxiliary drive shaft may be manually retracted by the user pivoting said retention lever to move said retention plate slot to the outwardly extended position and disengage said latch element from said spool reduced diameter portion and pulling said retraction rod rearwardly, and thereafter releasing said retention lever to allow said retention plate to be moved by the force of said torsion spring to its inwardly retracted position such that said retaining slot of said retention plate is engaged on said auxiliary drive shaft reduced diameter portion near its front end.

* * * * *